US008794463B2

(12) United States Patent
Rio Gonzalez et al.

(10) Patent No.: US 8,794,463 B2
(45) Date of Patent: Aug. 5, 2014

(54) SELF-ASSEMBLABLE CONTAINER FOR GENERIC USE AND MANUFACTURING METHOD THEREOF

(76) Inventors: Juan José Rio Gonzalez, San Pedro de la Paz (CL); Santiago Antonio Querol Puig, Los Alamos (CL)

( * ) Notice: Subject to any disclaimer, the term of this patent is extended or adjusted under 35 U.S.C. 154(b) by 0 days.

(21) Appl. No.: 13/184,968

(22) Filed: Jul. 18, 2011

(65) Prior Publication Data

US 2011/0309072 A1 Dec. 22, 2011

(30) Foreign Application Priority Data

Jun. 22, 2010 (CL) ..... 779-2010

(51) Int. Cl.

| | |
|---|---|
| ***B65D 6/14*** | (2006.01) |
| ***B65D 6/24*** | (2006.01) |
| ***B65D 90/08*** | (2006.01) |
| ***B65D 21/032*** | (2006.01) |
| ***B65D 21/036*** | (2006.01) |

(52) U.S. Cl.

USPC ..... 220/4.28; 220/690; 220/682; 220/677; 220/691; 220/198.2; 220/199; 206/503; 206/509; 206/511; 217/13

(58) Field of Classification Search

USPC ..... 220/4.28, 690, 638, 682, 677, 691; 229/198.2, 199, 915, 919, 125.42; 206/503, 509, 511; 217/13

See application file for complete search history.

(56) References Cited

U.S. PATENT DOCUMENTS

| | | | | |
|---|---|---|---|---|
| 3,965,327 A | | 6/1976 | Ehlscheid et al. | |
| 4,245,773 A | * | 1/1981 | Stollberg | 206/509 |
| 4,343,849 A | * | 8/1982 | Sutton et al. | 428/157 |
| 4,426,015 A | * | 1/1984 | Preston et al. | 229/117.28 |
| 4,867,327 A | * | 9/1989 | Roland | 217/12 R |
| 5,002,224 A | * | 3/1991 | Muise | 229/169 |
| 5,013,870 A | | 5/1991 | Navazo | |
| 5,662,508 A | * | 9/1997 | Smith | 446/128 |
| 5,882,746 A | | 3/1999 | Hoffman | |

(Continued)

FOREIGN PATENT DOCUMENTS

| | | |
|---|---|---|
| EP | 1 834 884 A1 | 9/2007 |
| ES | 273049 | 11/1983 |
| ES | 1 072 456 | 7/2010 |
| GB | 2 423 076 B | 8/2006 |

OTHER PUBLICATIONS

Search Report dated Jun. 10, 2013 for Application No. ES 201131258.

(Continued)

*Primary Examiner* — Fenn Mathew
*Assistant Examiner* — Jennifer Castriotta
(74) *Attorney, Agent, or Firm* — Ladas & Parry LLP

(57) ABSTRACT

A self-assemblable container, manufactured from ecologic materials such as standard fiberboard, comprising as its main structural elements a bottom, two longitudinal sides and two transverse sides, all of a quadrangular shape and having cauterized perimetrical faces from obtaining the main structural elements by a perimetrical laser cutting process, the main structural elements being assembled together by the insertion of flexible tabs into receiving slots, the sides of two main structural elements which in the assembled container are adjacent each other having one or the other so as to correspond, wherein the container may further comprise an antis-agging brace, a lid and/or two transverse laths.

22 Claims, 37 Drawing Sheets

(56) References Cited

U.S. PATENT DOCUMENTS

| | | | | |
|---|---|---|---|---|
| 7,300,110 | B1 | 11/2007 | Debien | |
| 2007/0075043 | A1 * | 4/2007 | Riogonzalez et al. | 217/13 |
| 2008/0078751 | A1 | 4/2008 | Abrott | |
| 2009/0101236 | A1 | 4/2009 | Bocke | |
| 2010/0006628 | A1 | 1/2010 | Jensen | |

OTHER PUBLICATIONS

Substantive Examination Report date Jan. 8, 2014 for Application No. ES 201131258.

Opposition Writ dated Dec. 16, 2013 for Application No. ES 201131258.

* cited by examiner

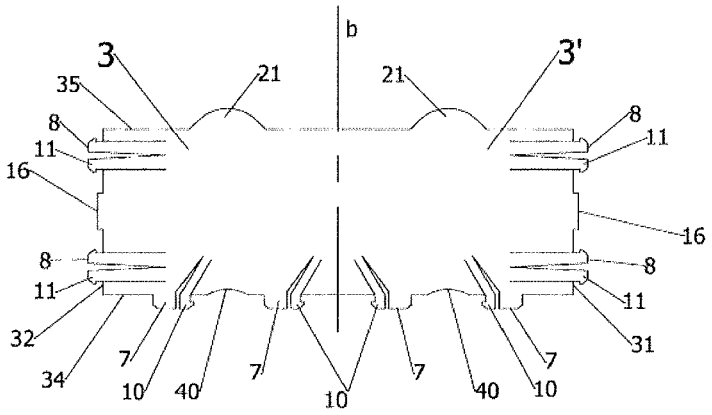
Fig. 1.1
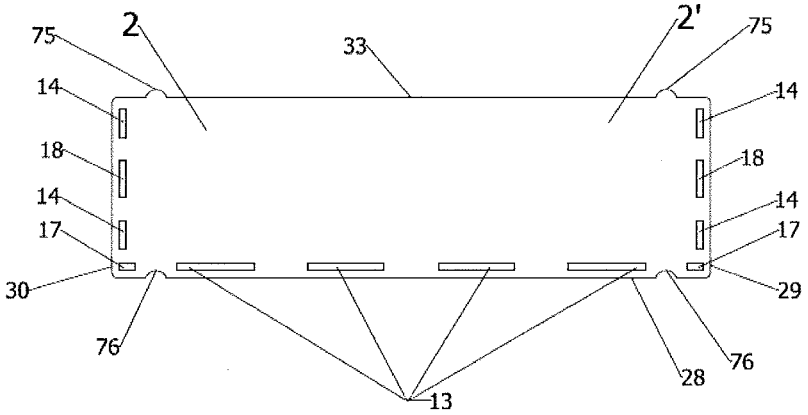
Fig. 1.2
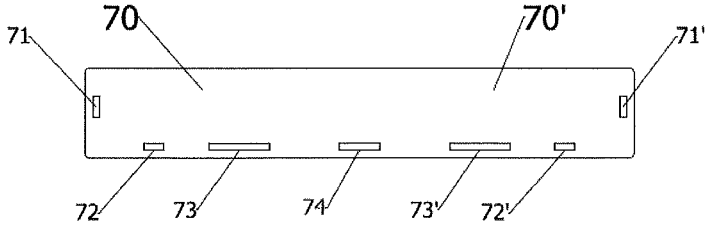
Fig. 1.3

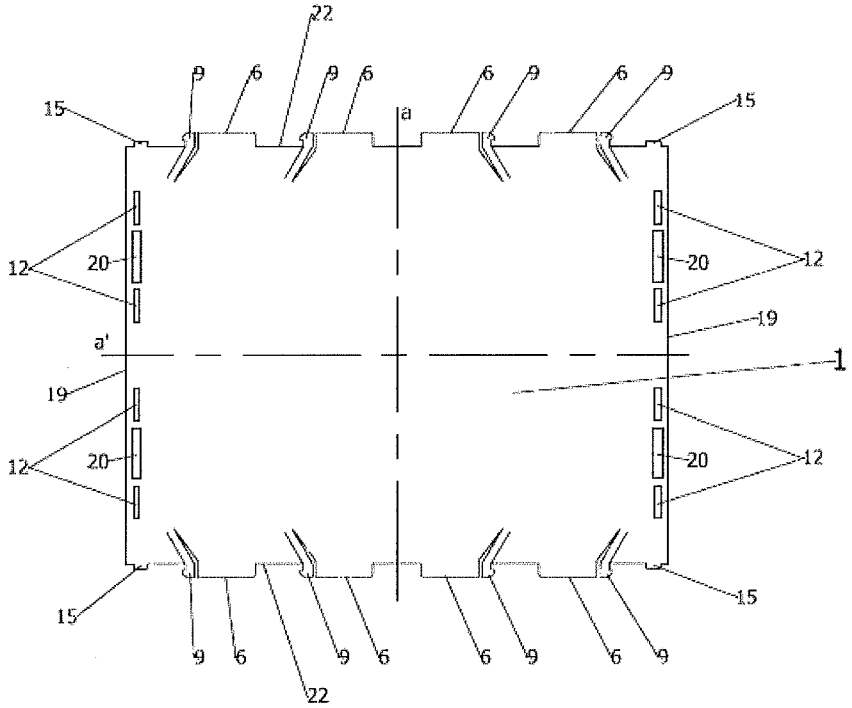
Fig. 1.4
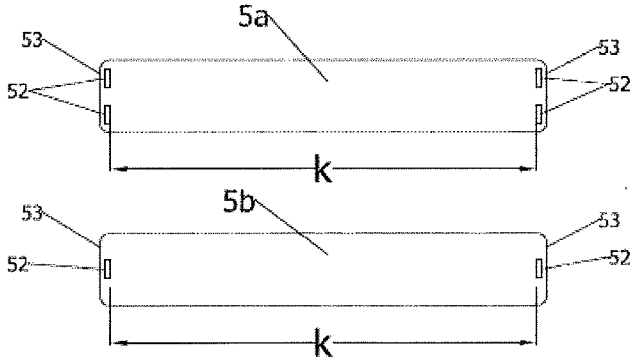
Fig. 1.5

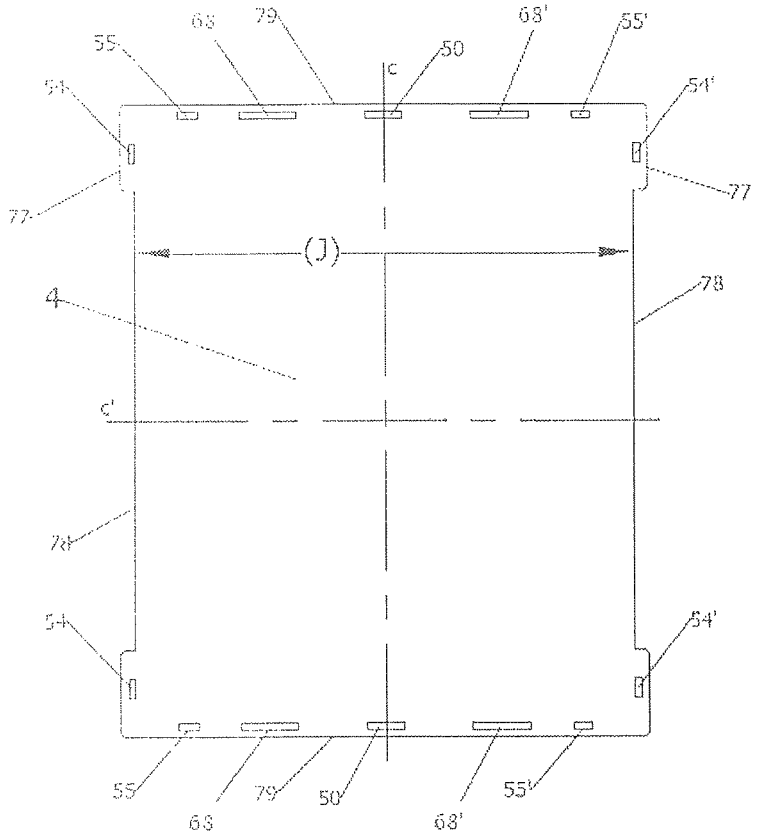
Fig. 1.6

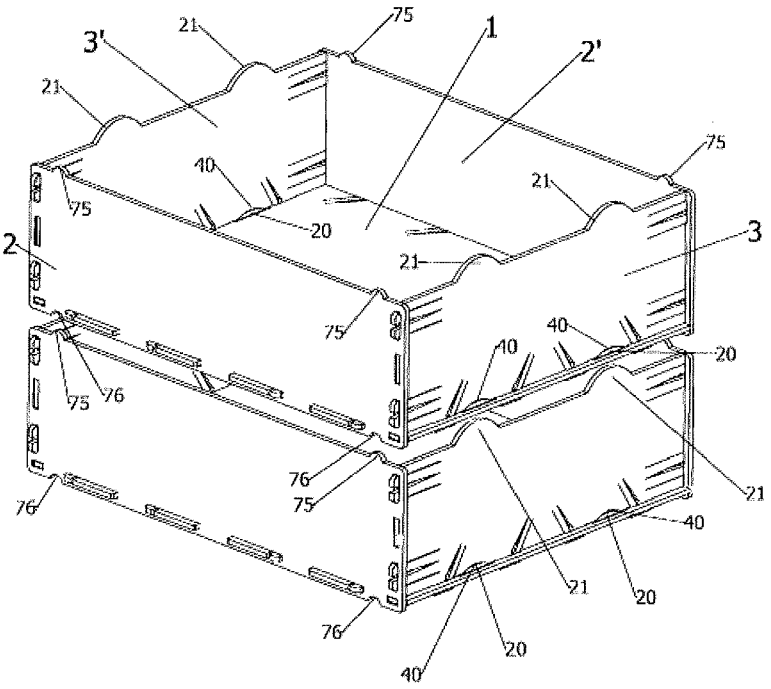
Fig. 8.1
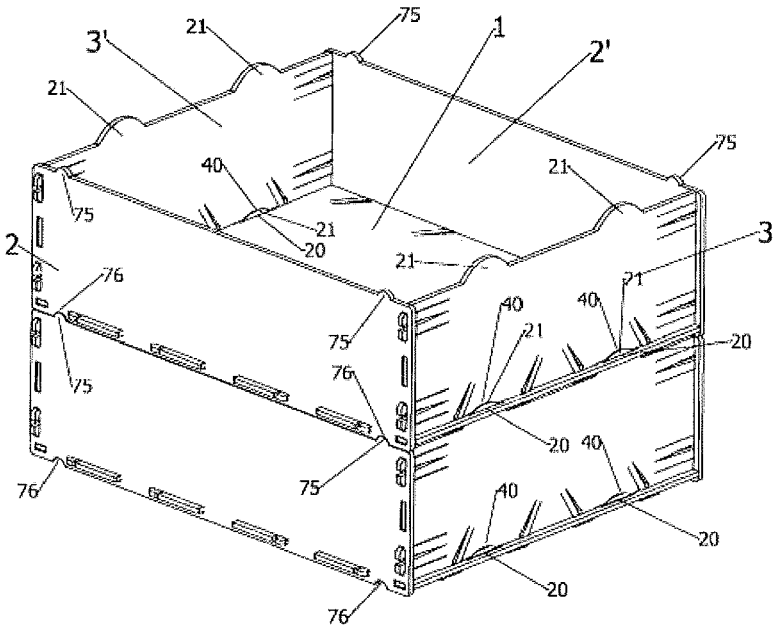
Fig. 8.2

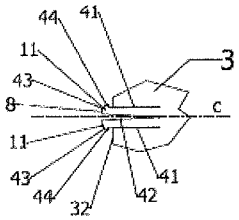
Fig. 9
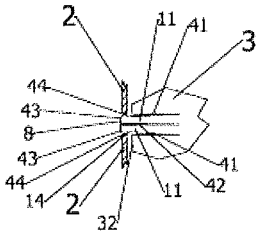
Fig. 10
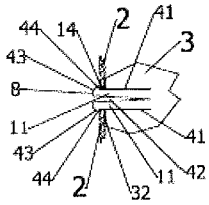
Fig. 11
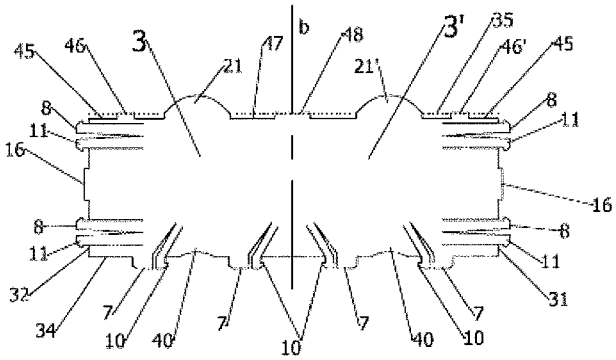
Fig. 12.1
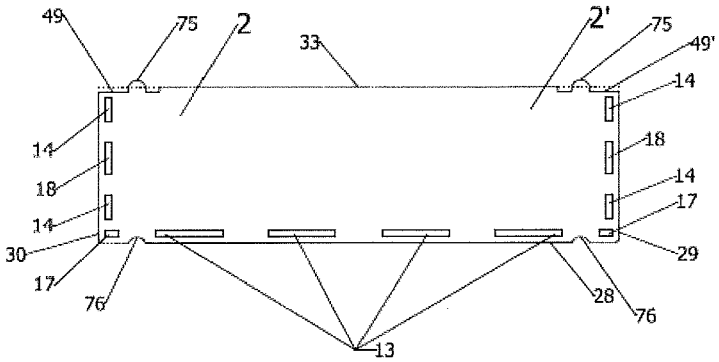
Fig. 12.2

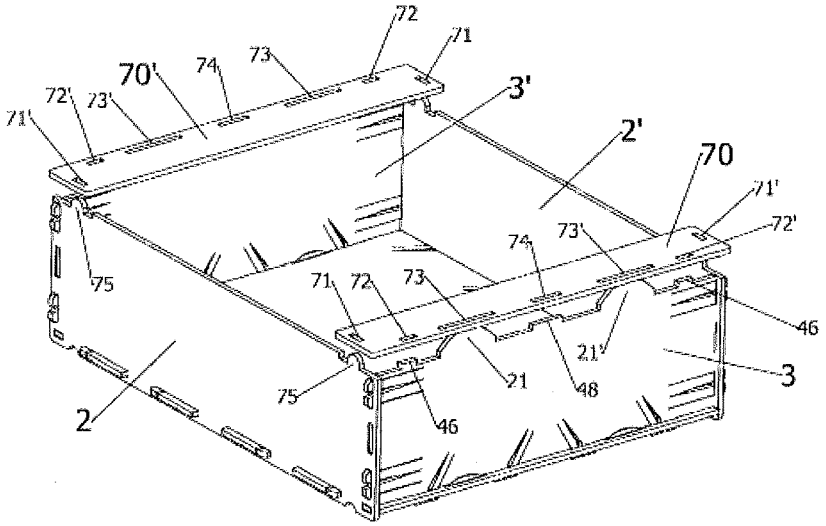
Fig. 13.1
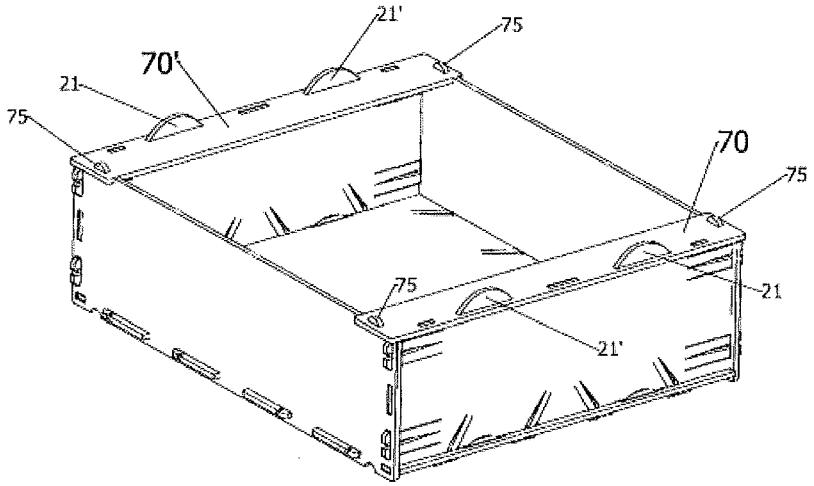
Fig. 13.2

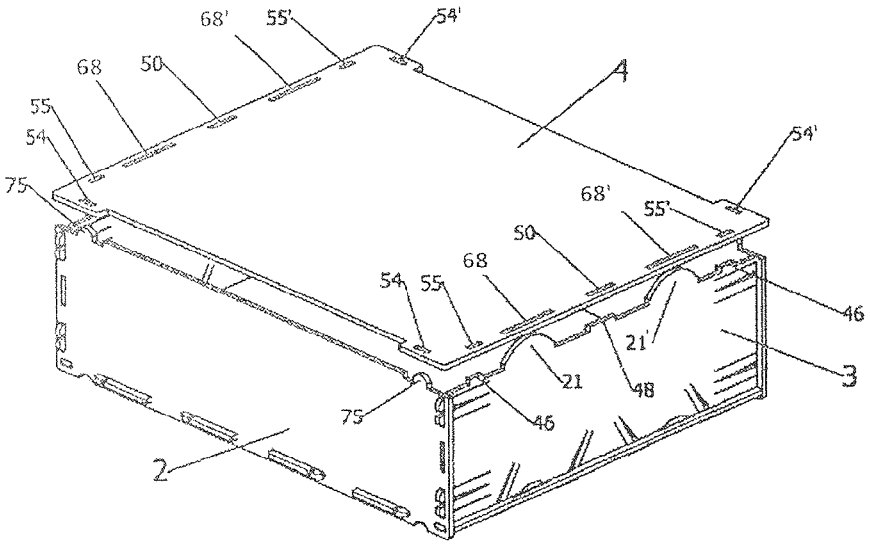
Fig. 14.1
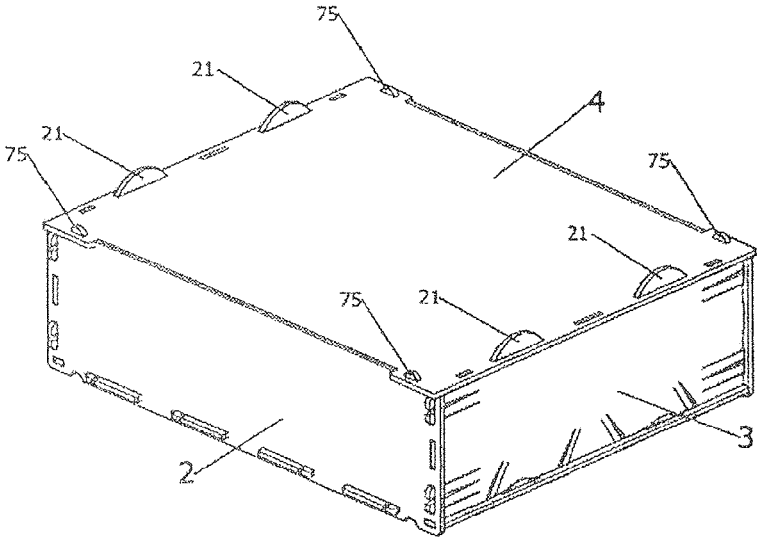
Fig. 14.2

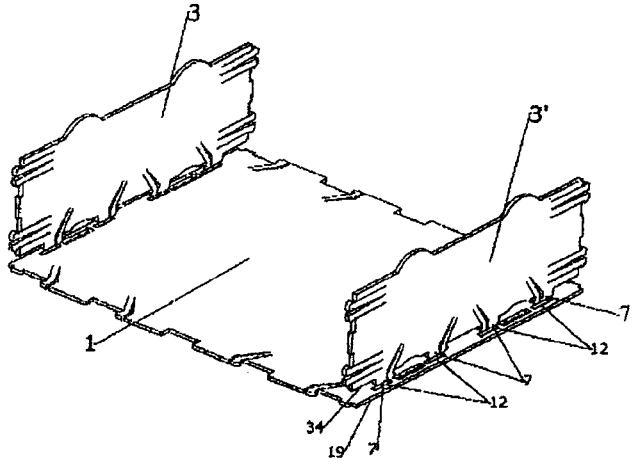
Fig. 15.1
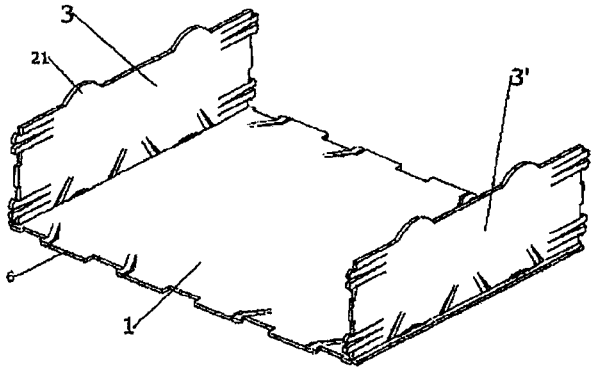
Fig. 15.2

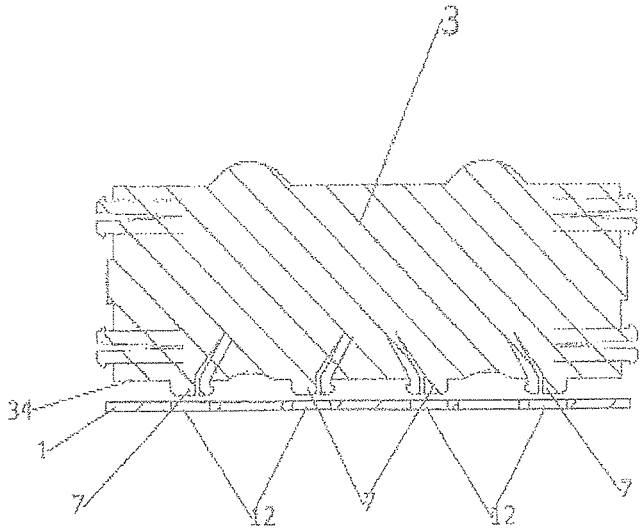
Fig. 15.3
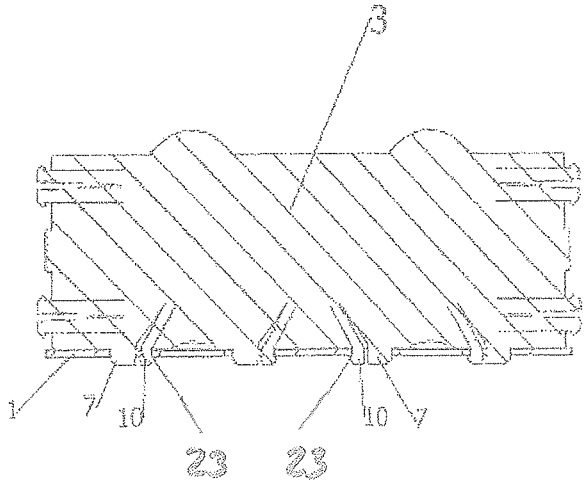
Fig. 15.4

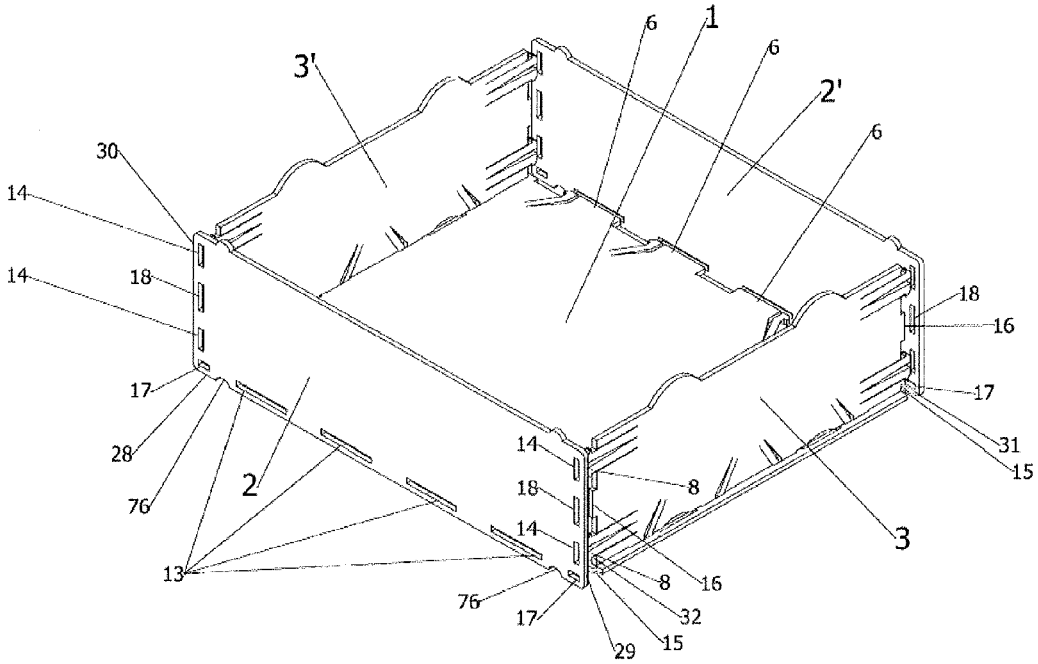
Fig. 16.1
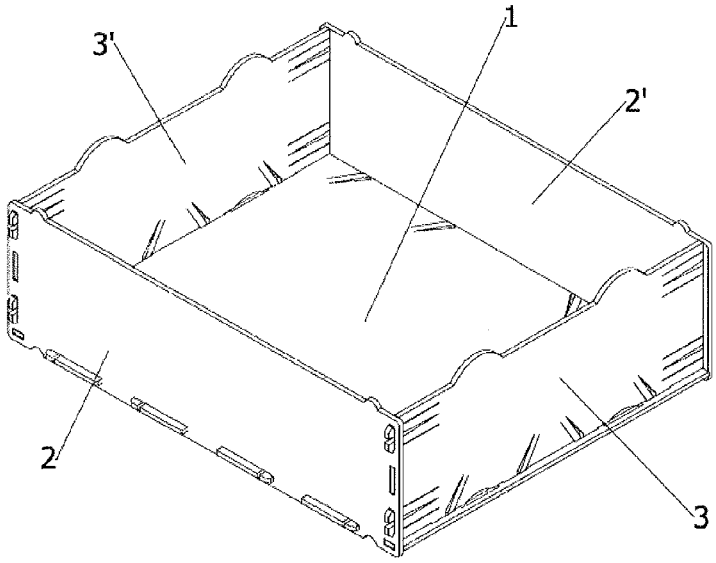
Fig. 16.2

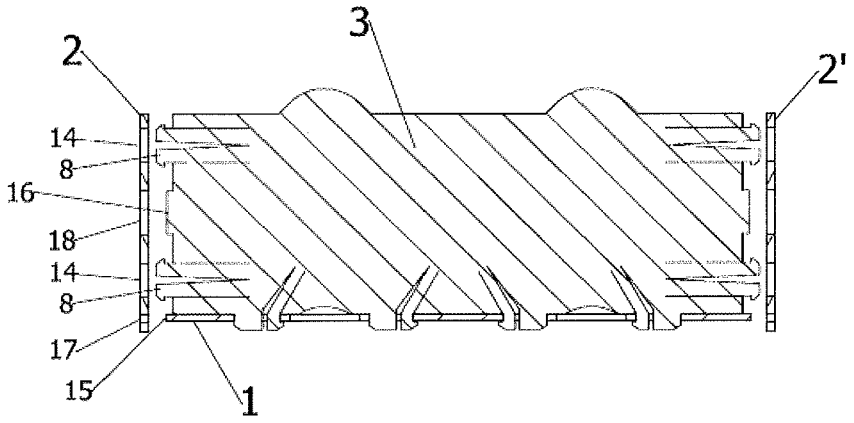
Fig. 16.3
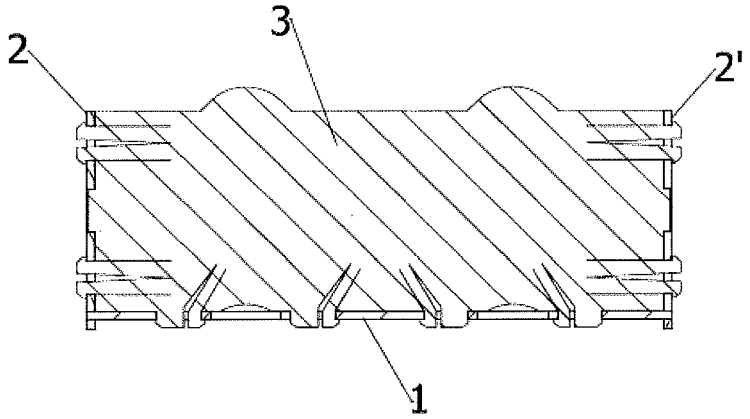
Fig. 16.4

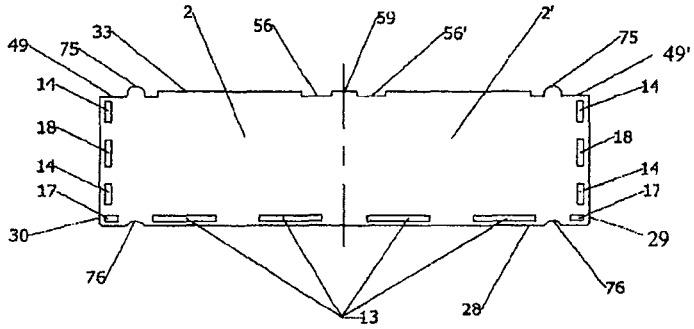
Fig. 17.1
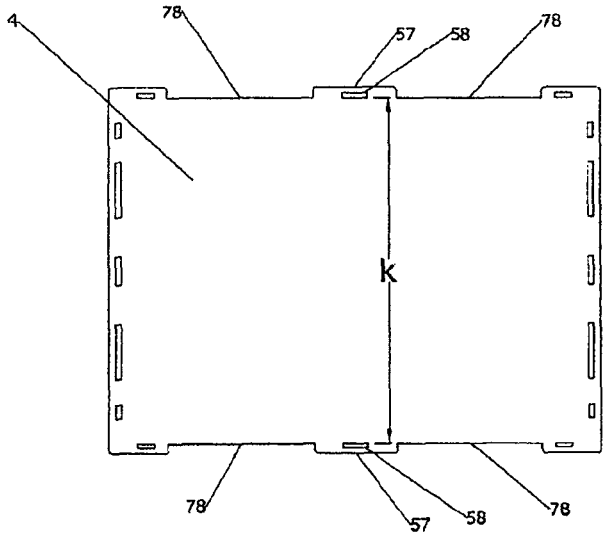
Fig. 17.2

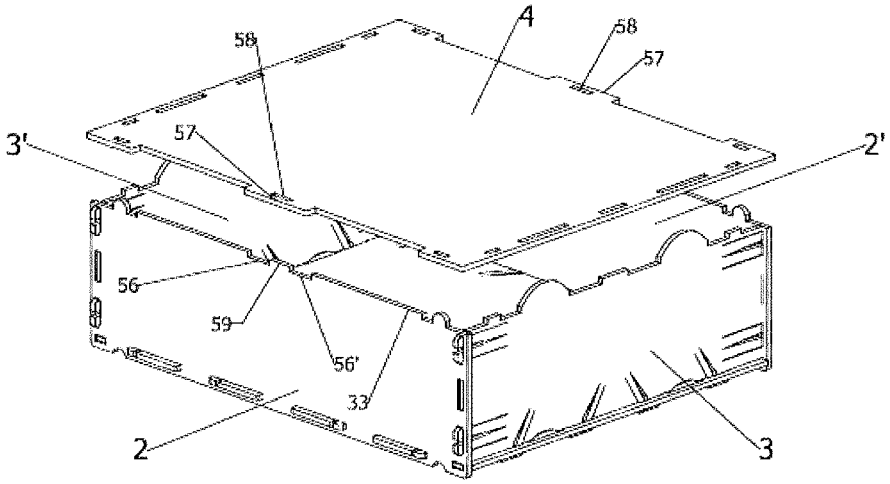
Fig. 18.1
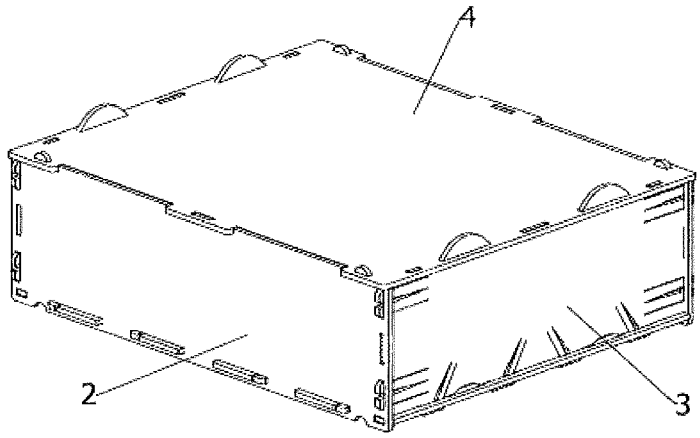
Fig. 18.2

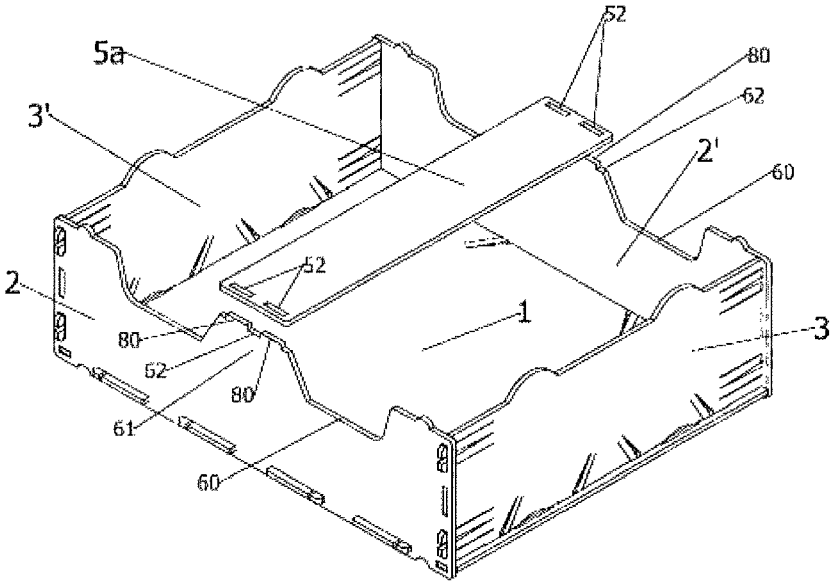
Fig. 26.1
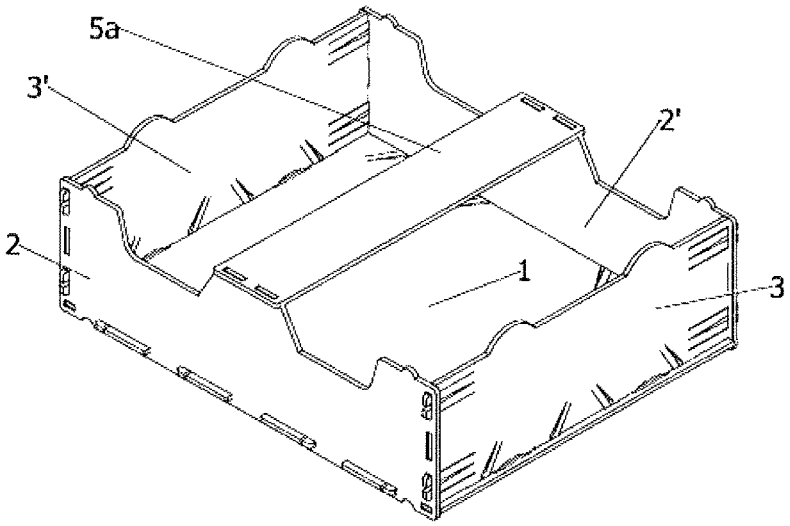
Fig. 26.2

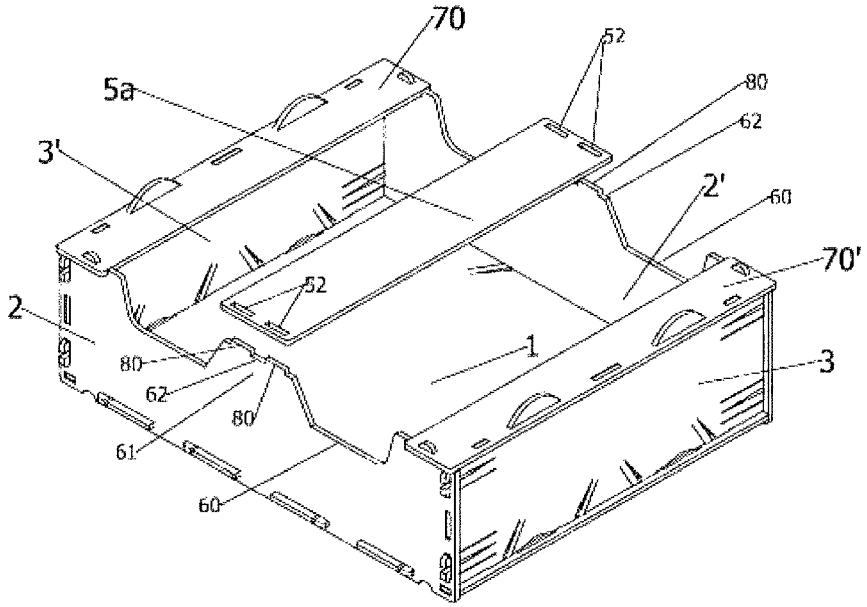
Fig. 27.1
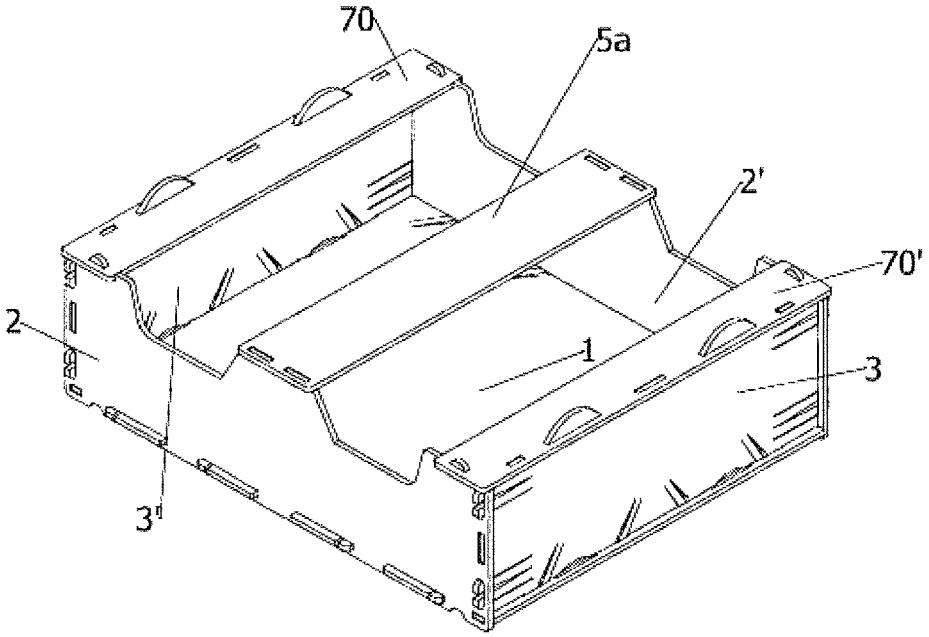
Fig. 27.2

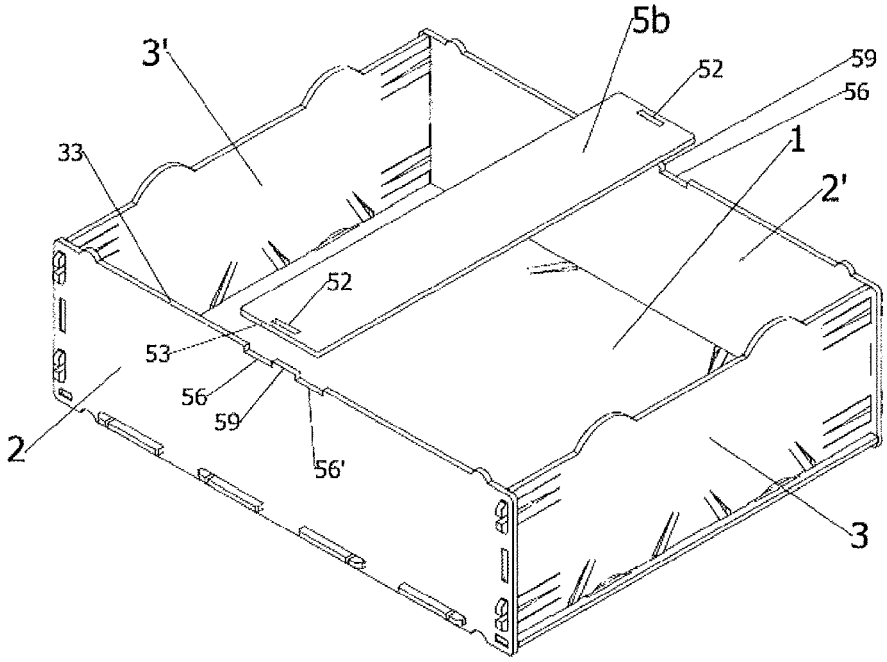
Fig. 28.1
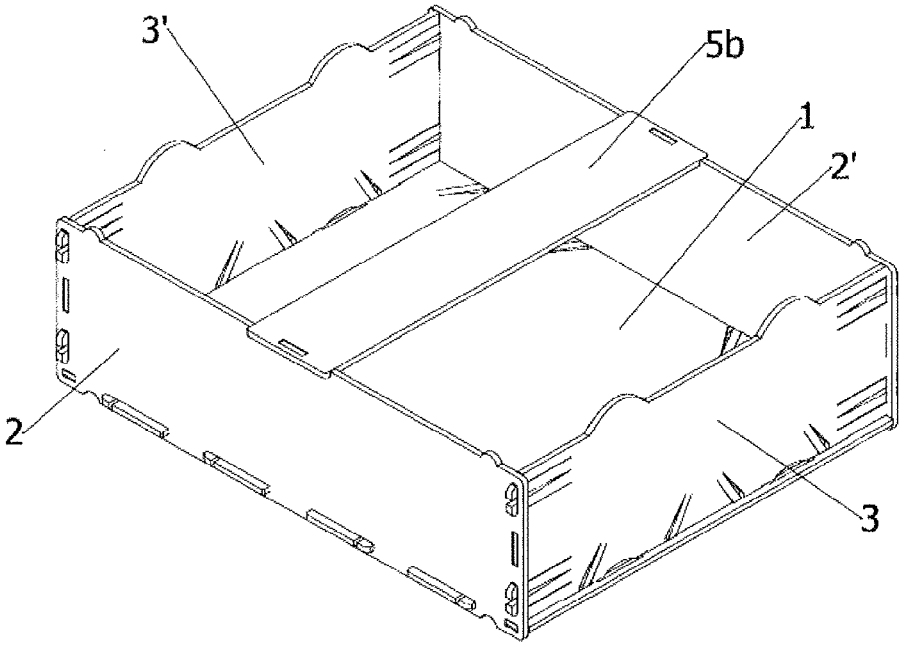
Fig. 28.2

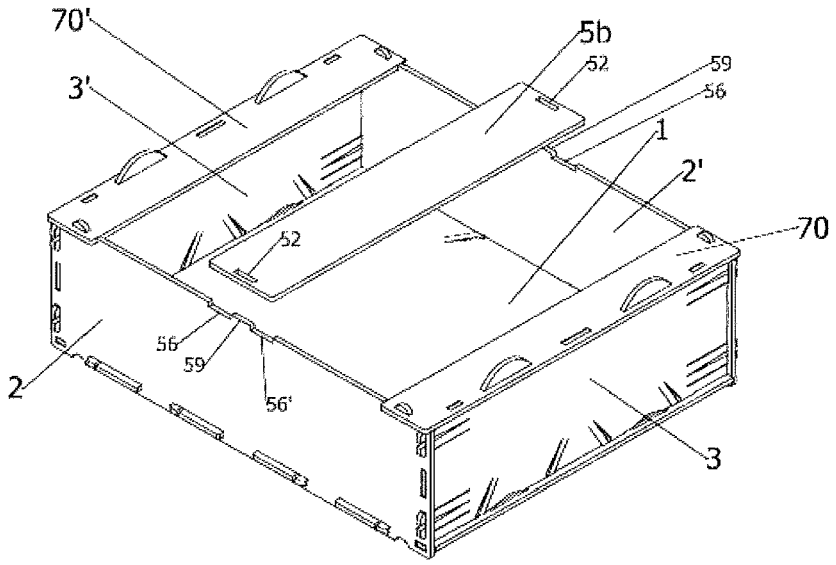
Fig. 29.1
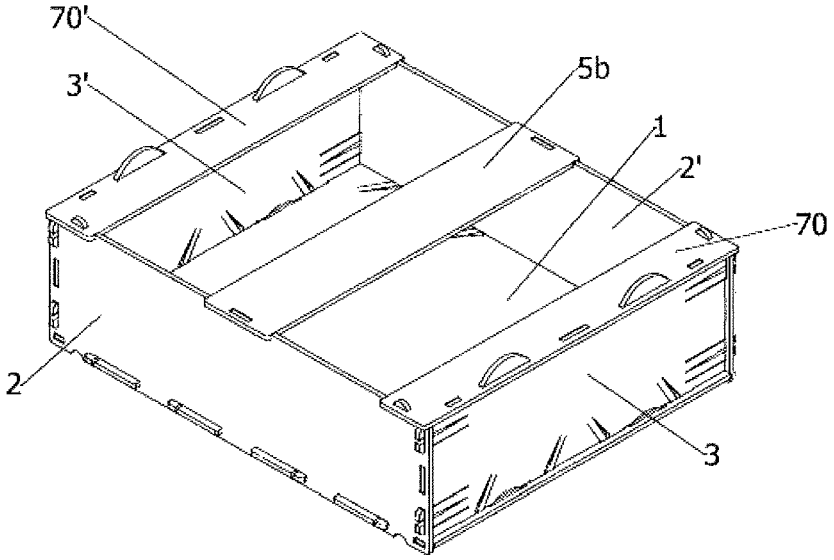
Fig. 29.2

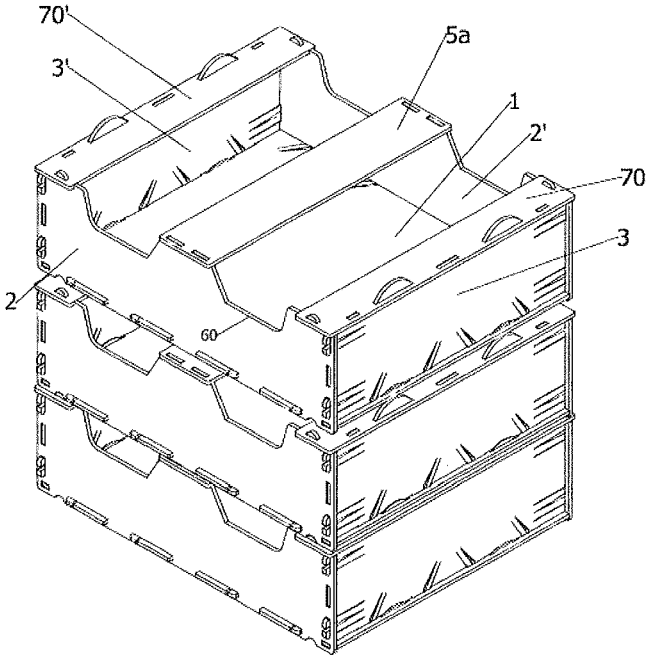
Fig. 30.1
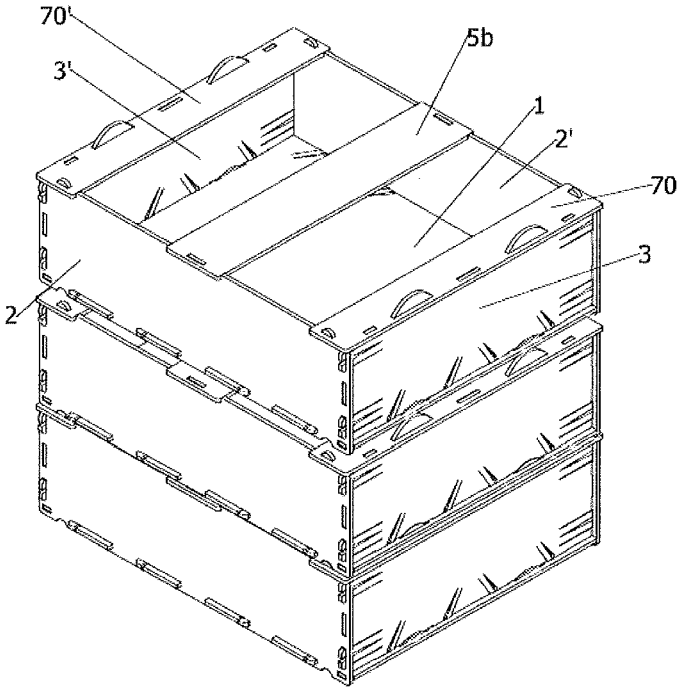
Fig. 30.2

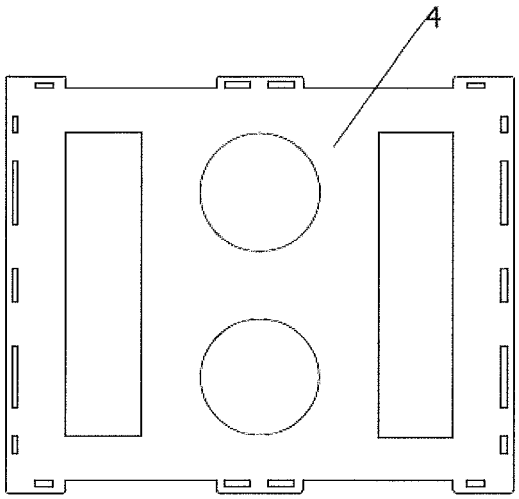
Fig. 31.1
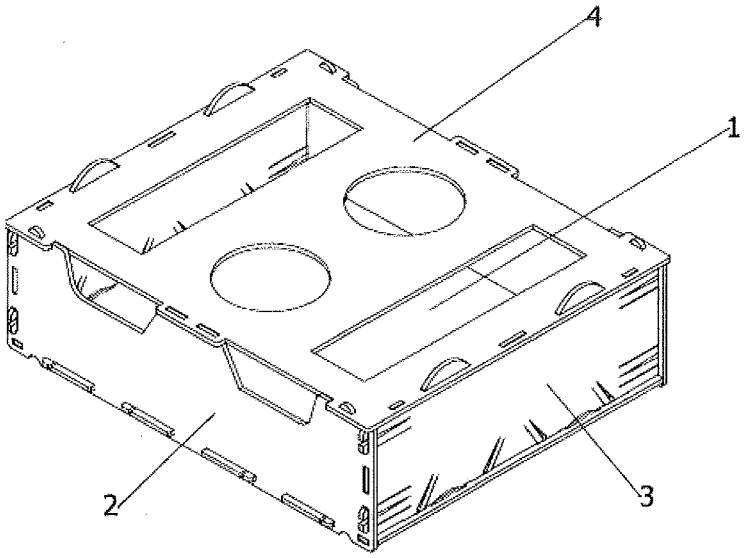
Fig. 31.2

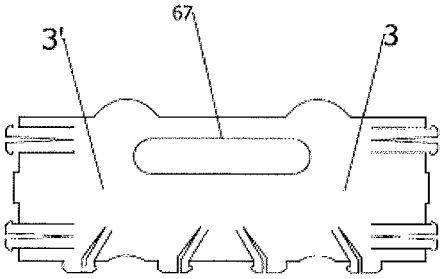
Fig. 32.1
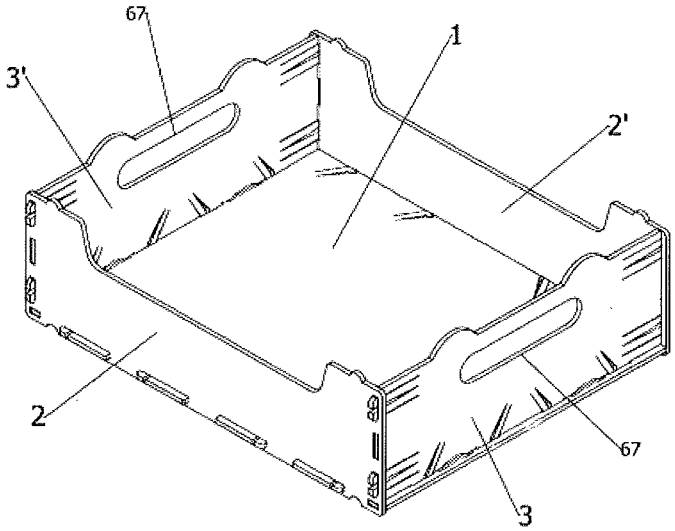
Fig. 32.2

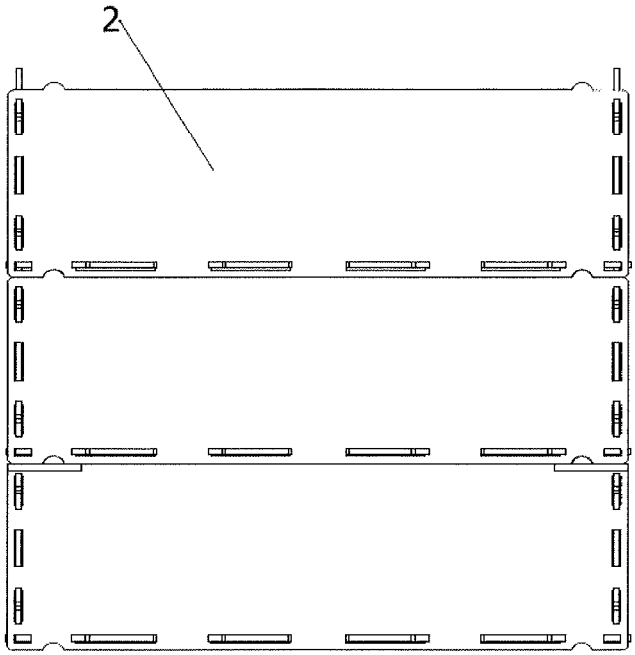
Fig. 33.1
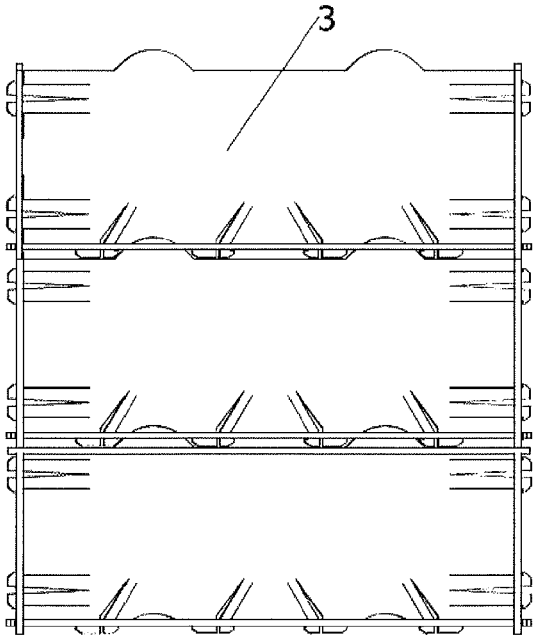
Fig. 33.2

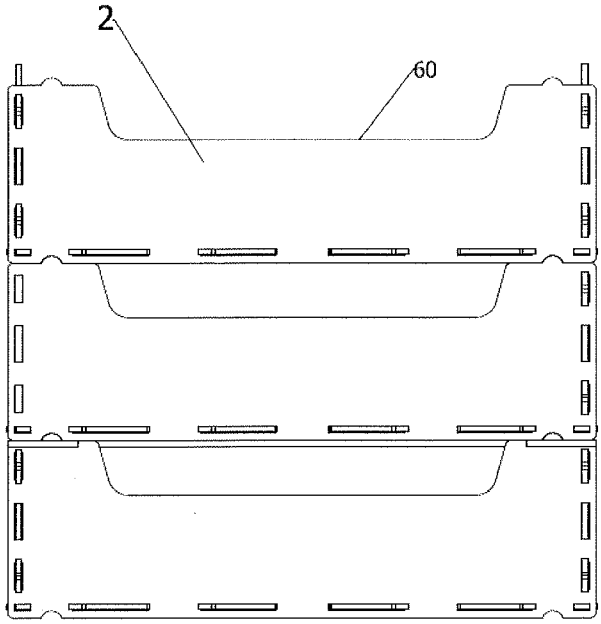
Fig. 34.1
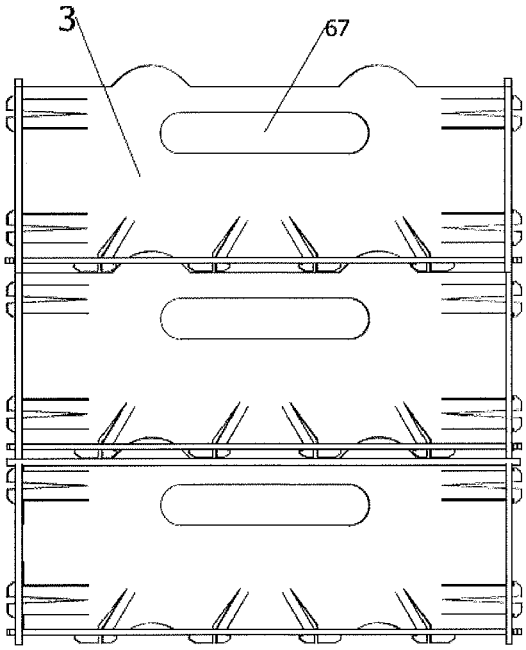
Fig. 34.2

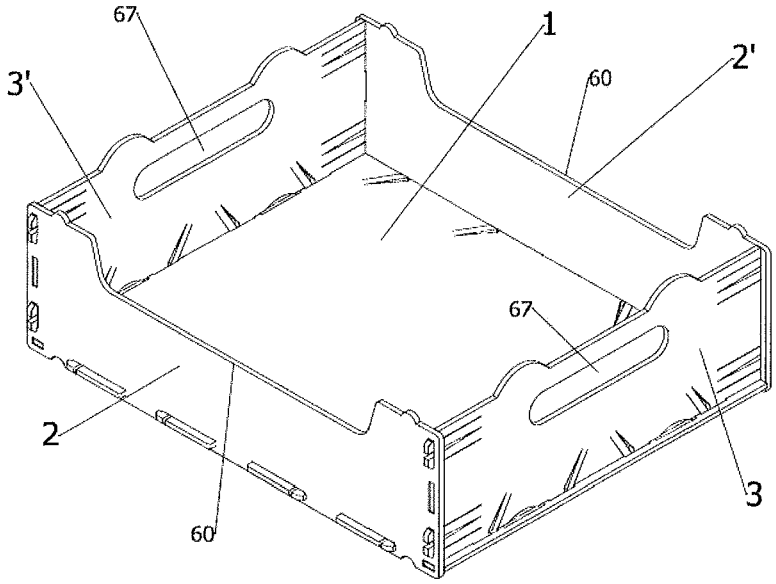
Fig. 34.3
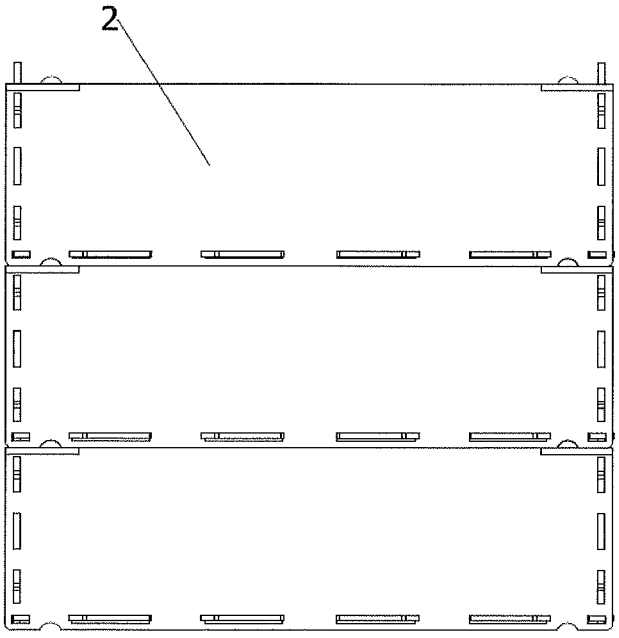
Fig. 35.1

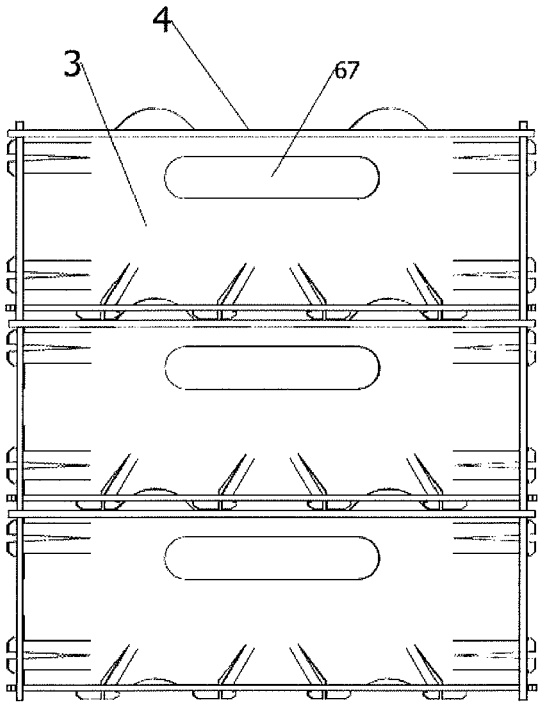
Fig. 35.2
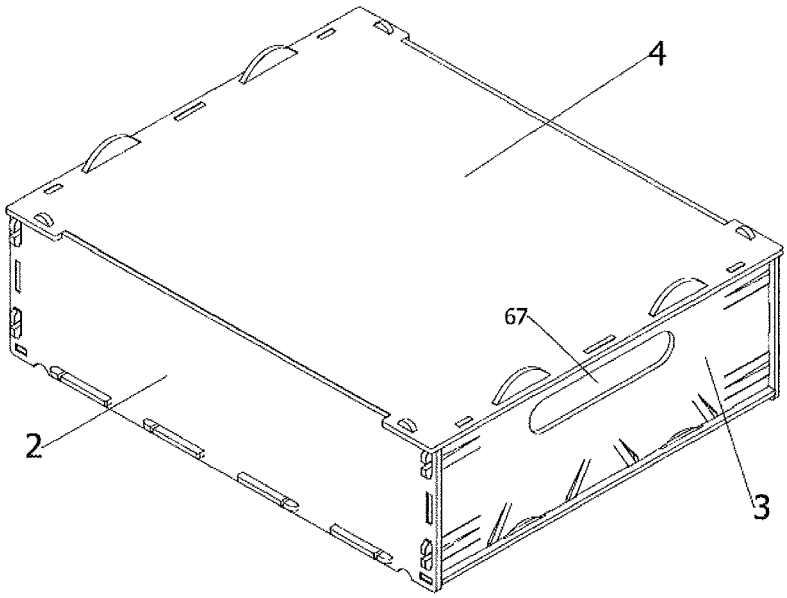
Fig. 35.3

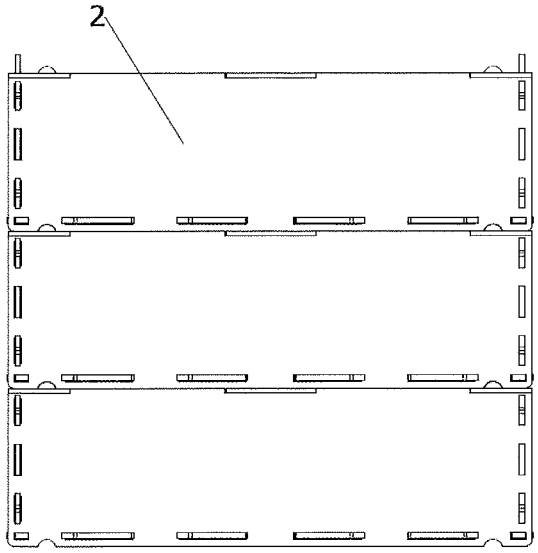
Fig. 36.1
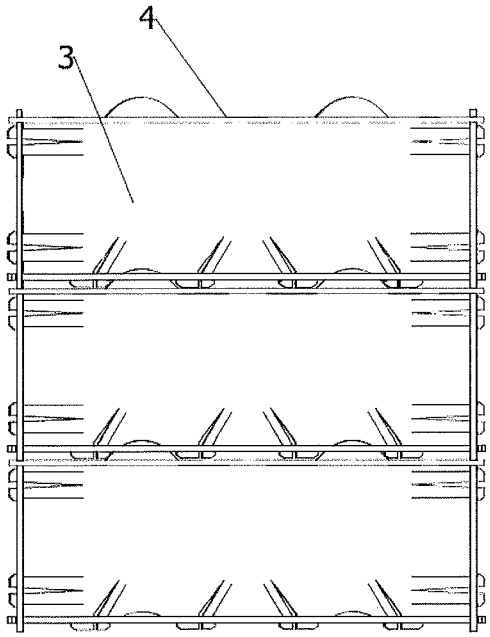
Fig. 36.2

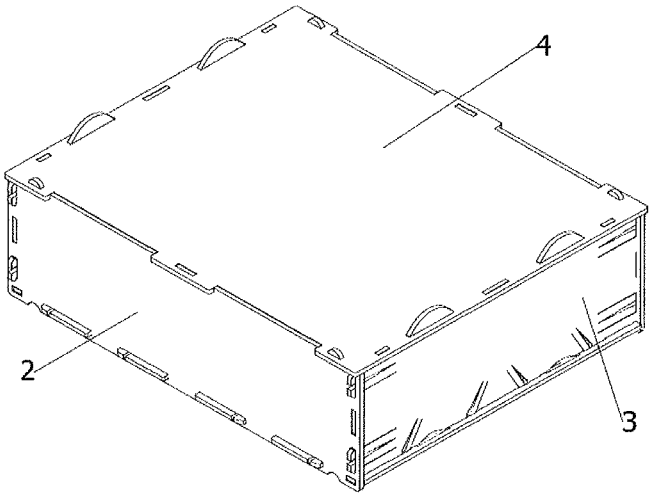
Fig. 36.3
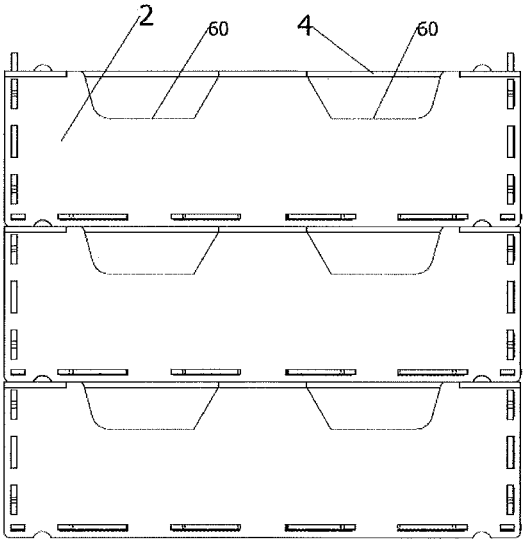
Fig. 37.1

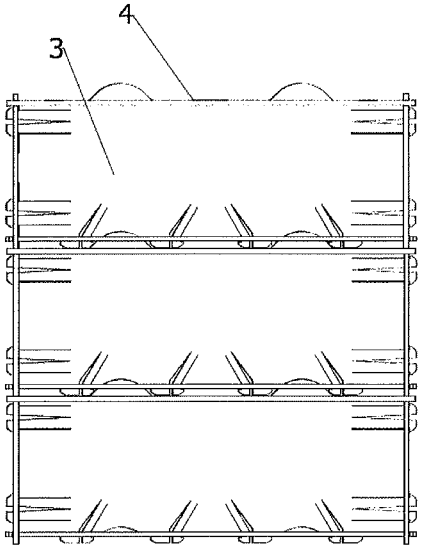
Fig. 37.2
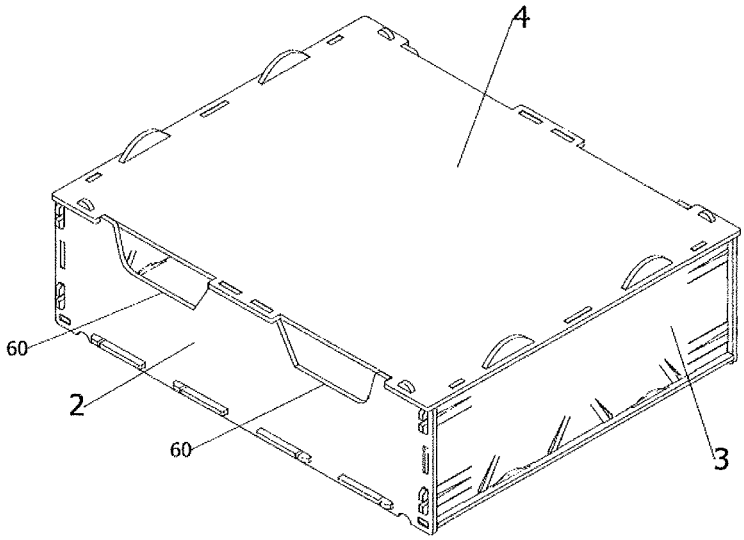
Fig. 37.3

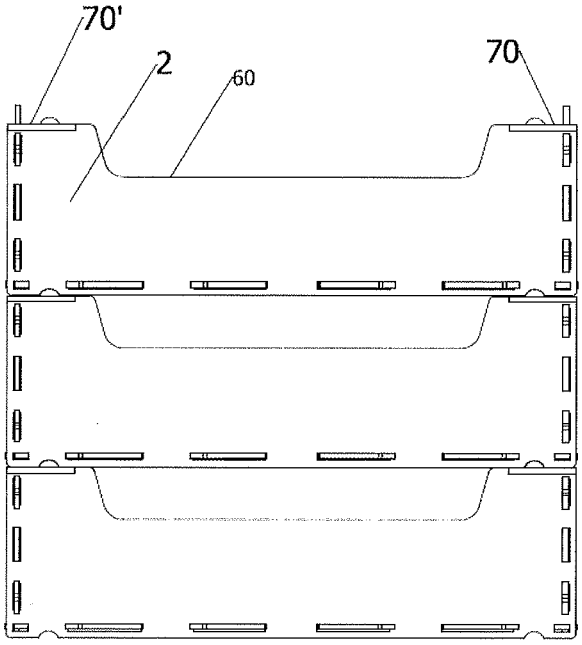
Fig. 38.1
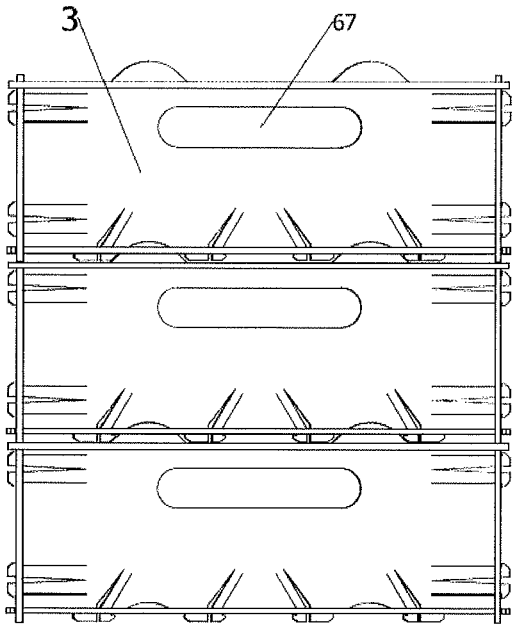
Fig. 38.2

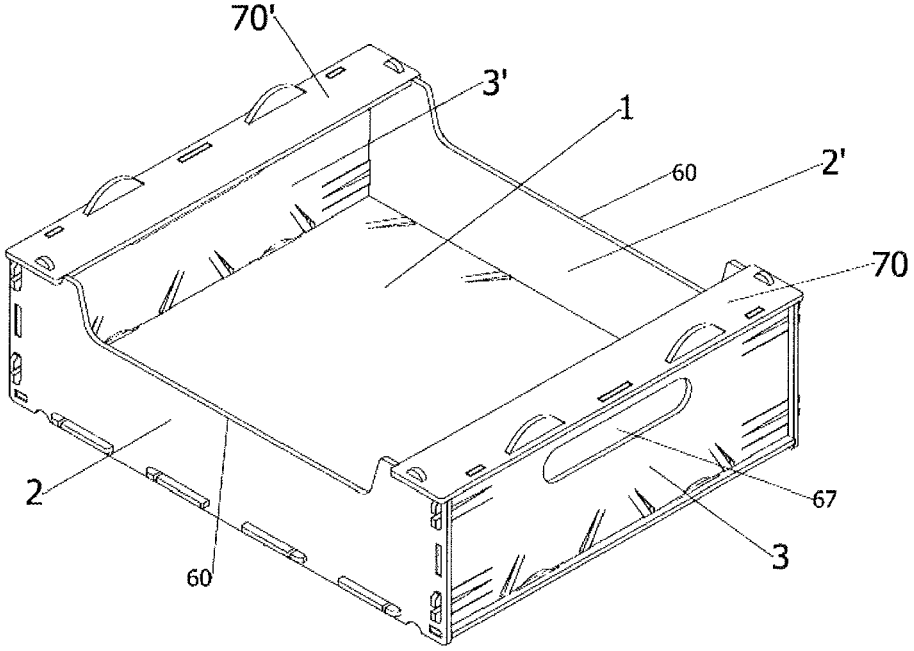
Fig. 38.3
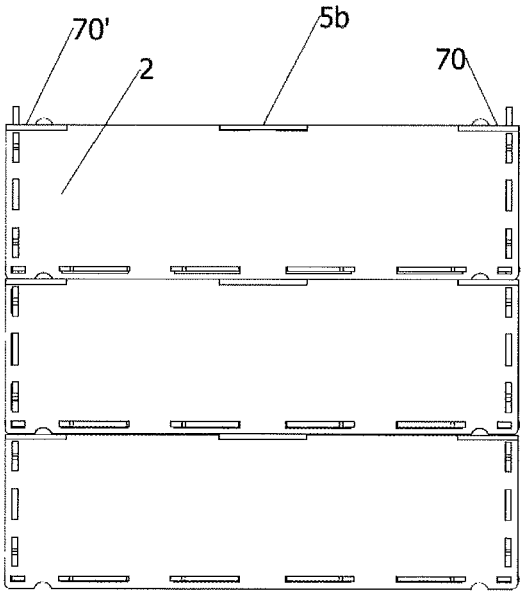
Fig. 39.1

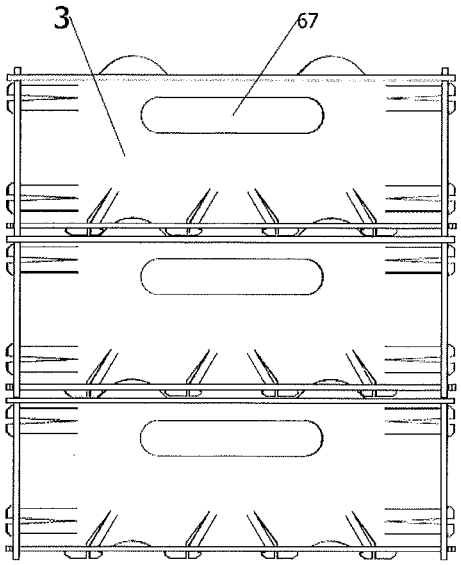
Fig. 39.2
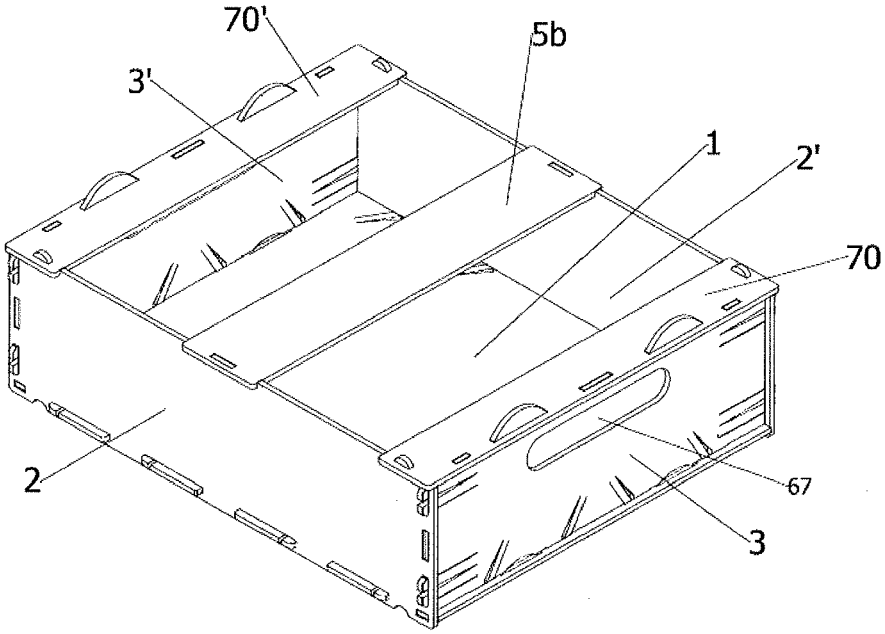
Fig. 39.3

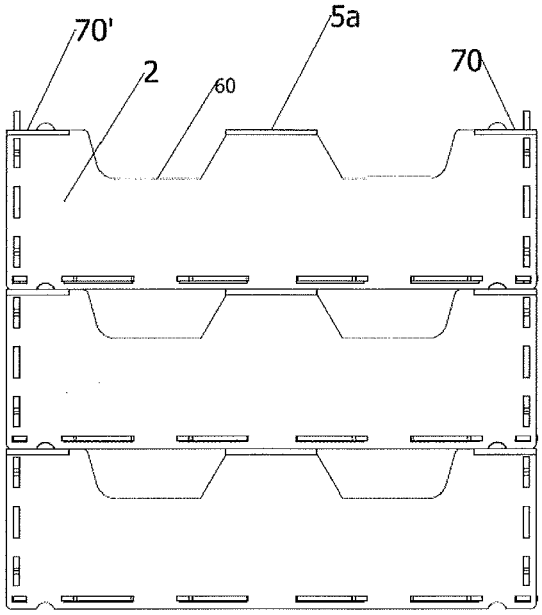
Fig. 40.1
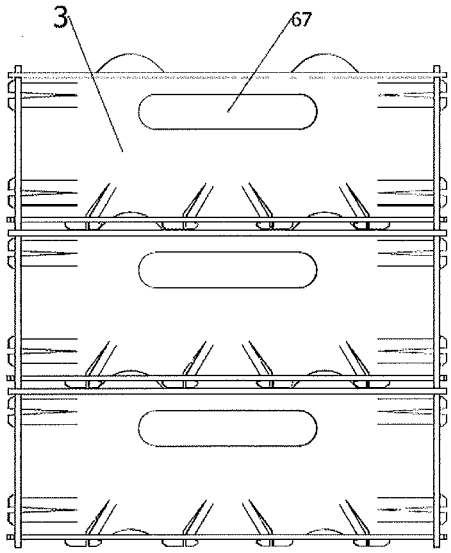
Fig. 40.2

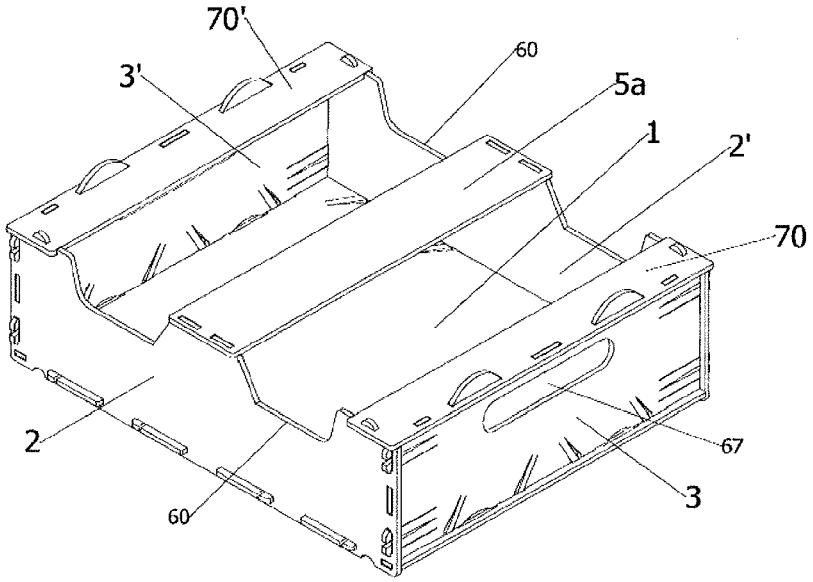
Fig. 40.3

SELF-ASSEMBLABLE CONTAINER FOR GENERIC USE AND MANUFACTURING METHOD THEREOF

FIELD OF THE INVENTION

The present invention pertains to the field of self-assemblable containers for generic use regularly employed to transport goods. More specifically, the invention refers to an improved container of this type that being developed from ecologic materials allows the containment and close contact with food products in its interior, and also refers to a method of manufacturing said container.

BACKGROUND OF THE INVENTION

In the present systems for transporting goods in cardboard boxes or containers, where both resistance to relative moisture and contact with fluids are a major factor, there is in addition to the condition of being non-returnable and/or capable of being in direct contact with food products, the issue of structural strength and international regulations in this respect.

Typically, cardboard boxes that are either made from a corrugated or a compact material for these purposes, though they have the advantage of being transported in a flat or unassembled condition to the areas where they shall subsequently be filled, thus saving transport space, involve the disadvantage of losing their structural strength in the presence of humidity. To overcome this drawback these cardboard boxes are sprayed or primed at present with paraffins or waxes in an attempt to keep moisture from permeating the surface of their inner and outer faces. It can be said in this regard that it is not possible to seal the perimetrical edges or faces of the cardboard by these processes, and moisture usually penetrates the cardboard box through said faces and edges, weakening at the same time its structure. The structure of pallets with this type of containers run a high risk of collapse of the load when subjected to these environmental conditions.

The standards being implemented at present by countries that have advanced with regard to contact of the containers with foodstuffs are in the line of banning the use of these treatments of either paraffin, wax or silicone sprayed over the cardboard, thereby further exacerbating the problem. This increases the need for a reliable transport solution without risk to health and complying with all the regulations.

Furthermore, these standards tend to support the ecology, renewability and biodegradability of "non returnable" single-use containers that are in contact with food products.

Countries such as the United States of America and the European Union are placing all kinds of obstacles and problems on food imports contained in non-returnable and single use containers where the container does not meet these expectations.

Likewise analysis of plastic containers for these same purposes shows that these are also being banned because they are difficult to recycle owing to their non-returnable condition with the imposition of economic quotas and because of their structure usually manufactured by injection molding, which makes them very difficult to transport in a deployed or flat format from the manufacturing plant to the filling facility, thus increasing costs as air represents a major part of the transported volume.

The wooden boxes regularly used for this purpose also comprise components that are aggressive to the environment, are not safe and are damaging to health, such as staples and nails. These are also being banned by the present regulations due to their high degree of oxidation in high humidity environments and to the danger they present when users handle them.

Patent EP 1 834 884 proposes a mono-material container for horticultural use that, to some extent, aims to solve the problems of the prior art. However, it has the disadvantage that as its parts are obtained by a die or saw cutting process, the perimetrical faces of said parts are left with its internal fibers exposed and physically degraded after impact or cutting, making them lose their normal density and causing them likewise to easily lose structural stability at their contours due to the sponge-like effect or response that takes place throughout the cutting perimeter of each component, leaving them prone to moisture penetration as in the case of cardboard.

As said container analyzed is not provided with fastening elements that are subject to tensile work, and as the elements that form said container are supported structurally joined exclusively by direct compression work of fully rigid male part flaps or flukes over female part slots, these elements get weakened, degraded and softened by the penetration of moisture inside and fail to correctly perform their structural setting function. Moreover, said container requires the use of additional slits and aeration holes to make its ventilation inside easier further increasing its structural weakness because it provides a greater number of sides through which moisture may penetrate.

Fastening elements called clips or flexible tabs are already available in the market, these elements being subject to tensile strength for securing the assembly of the different elements with each other. These clips are usually made from injection molded plastic materials and include different ribs and/or flexible braces, which as flukes, once inserted as arrows or tabs harpoon prongs prevent their return or withdrawal from the place they are lodged in. However, elements of this type can not be developed in the same way when using ecologic materials such as wood fibers, because they are not able to withstand high tensile efforts owing to their low density and loss of strength in the contours when said flukes or claws are cut with saws or dies.

Therefore, the known prior art presents the main drawback of the structural weakness of existing containers made from cardboard or wood fibers when subjected to the inner pressure of the contained load, either due to compression of the contents or due to inner displacement thereof during transport, resulting in subsequent outward sagging of the sides as, for example, it occurs with bulk packaging where the contents in the interior subjects the container sides to high pressures that generate said outward sagging effect, which directly leads to contact reduction in the outer perimeter of the vertically stacked containers. The load on the pallets is thus made unstable when said contact is reduced, and is likewise reduced the capacity of the containers placed on the lower layers and supporting all the weight of the upper layers or rows to withstand vertical compression. This vertical compression effect is translated into a logical increase of said sagging or horizontal deformation, generating a chain effect that ends up destroying the containers in the lower rows and spoiling their contents.

Therefore, there is still in the art a need for a self-assemblable container that provides at least a partial solution to the above described problems, a greater ease of assembly of the container, with fewer mechanical operations for its manufacture than previously known containers, reducing at the same time the costs of production and assembly thereof.

SUMMARY OF THE INVENTION

The present invention refers in a first aspect of the same to a self-assemblable container, preferably made of ecologic materials, such as standard fiberboard, that comprises a bottom, two longitudinal sides and two transverse sides, said bottom and said longitudinal and transverse sides being obtained by means of perimetrical laser cutting. This cutting process, which is performed at an extremely high temperature, causes a reaction of the natural resins contained in the raw material, which result in a perimetrical cauterization that provides supplementary sealing of all the elements forming the container. Said cauterization prevents moisture penetration into the structural elements forming the container, providing long term structural stiffness to the perimetrical sides of the structural elements of the container, as compared to that of the fiberboard surface.

By reason of the laser cutting of the structural elements of the container according to present invention, it is possible now to manufacture containers comprising independent elements that are assembled together by means of flexible tabs with high tensile resistance, and dovetailed blocking lugs that when inserted into their lodging places prevent disassembly of the container and provide a structural stiffness higher than that of any other existing container developed from similar raw materials.

In a second aspect of the present invention, it refers to a manufacturing method of the structural elements of a self-assemblable container by means of laser cutting, obtaining in this way a perimetrical cauterization that provides supplementary sealing of the structural elements that make up said container, these structural elements being selected from the group comprising a bottom, longitudinal sides, transverse sides, a lid, a container antisagging brace and transverse laths.

The raw materials of origin employed in the self-assemblable container of the invention preferably consist of standard fiberboard available in the market, such as MDF or HDF in all of their categories, those with the E1 and E0 denomination, which have a composition free from formaldehyde and heavy metals, being the preferred ones for manufacturing containers that enable transport of foodstuffs.

The main structural elements making up the container according to the present invention are a bottom, two generally larger longitudinal sides and two generally smaller transverse sides that are of a substantially quadrangular shape. Further and as it shall be explained below in the present document, the container of the present invention may additionaly comprise an antisagging brace, a lid and/or two transverse laths.

With the present invention, and by means of the above described laser cutting, the container does not suffer from the usual degradation of the material that the container is made of, when in contact with high relative humidity, which is perfect for long distance transport of products having or being in contact with high fluid contents, refrigerated products during their transport to market and/or products with protracted transport phase.

The invention of this container offers, in addition, the possibility of being implemented in any size range adaptable to the common palletizing and transport standards.

Accordingly, the present invention refers to a container of generic use wherein the structural elements that comprise the same may be transported from their production phase to their point of use entirely unassembled, thereby saving on transport costs and wherein said structural elements are able to withstand long storage periods before being assembled together, without suffering from degradation on account of the level of perimetrical sealing of the components of the container, the latter being obtained by means of laser cutting.

The container of generic use of the present invention may easily be assembled, either manually or by automated machinery, not requiring the addition of supplementary fastening elements to its final structure.

According to an optional additional characteristic, the container of the present invention may be provided with a transverse blocking and bracing system on the upper part of its larger sides in order to avoid an outward sagging caused by the pressure applied on the sides from within by the contained load.

Said blocking and bracing system, as for example an antisagging brace, may be directly applied over a container configuration that is open on top and additionally provide use of its outer surface for a display over which to mold or print marks, notes or details concerning the product contained; or else it may be applied over a closed container configuration with an additional lid that performs identical bracing and transverse laths function also described in the present invention.

According to another additional optional characteristic, the container of the present invention may be provided with two transverse laths longitudinally placed on the upper part of the smaller sides of the container. These laths link and secure the angle formed by the coupling of said smaller sides with the larger sides, providing the finished container with greater torsional strength and a greater resistance to vertical load or stacking of containers placed one on top of the other.

According to another additional optional characteristic, the container of generic use according to the present invention, made for the transport of goods with high moisture content or with additional refrigeration and ventilation requirements, further contributes with the detail that it does not necessarily requires additional holes or orifices for its optimum ventilation because, as it. shall be further explained below, the geometric configuration itself of the flexible tabs that exist in the various elements that make up the container, forms perfectly distributed slots and free spaces that perform in turn the function of open orifices for the inner ventilation of the products. Thus a reduction in production costs is obtained, as it is not necessary to cut additional orifices, slots or hollows for optimum ventilation.

According to another optional additional characteristic of the present invention, the container of generic use is provided with at least two flap-like projections of a parabolic geometry located on its longitudinal and transverse sides, for use in optimum blocking and vertical stacking of one container on top of another thereby preventing the containers from falling or group-like moving during transport. These may have the additional function of retaining or blocking the additional lid and/or the optional transverse laths included as an additional characteristic to this invention.

According to another optional characteristic of the present invention, the container of generic use may be provided with a system of transverse laths for large loads that additionally ensure stacking stability and are positioned in a dovetail configuration between the joints of the longitudinal sides with the transverse sides, adding structural strength and additional vertical loading capacity to the finished container.

As explained above, since the structural elements that make up the container according to the invention are obtained by a laser cutting method, the perimetrical faces of these elements are perfectly sealed and cauterized, preventing in this way the penetration of moisture through the edges into the core of these elements.

Said container according to the present invention has as its main structural independent elements for assembling it a bottom, two longitudinal sides and two transverse sides, and it may be provided in addition with a possible upper closure lid, a possible transverse antisagging brace and/or two possible transverse laths, the installation of these last three elements being optional and said lid being configurable to perform in addition to its upper closure function, that of an antisagging brace.

According to an additional and preferred characteristic of the present invention, all these members are assembled together by different non-return pin clip systems provided on their perimeters. These pin clip systems consist of a defined number of flexible harpoon prong-like tabs that, when entering into their lodging places formed by rectangular holes and performing the function of female receivers of said tabs, ensure structural stability to the arrangement due to the tensile work exerted between these assembling elements. Furthermore and to prevent displacement of the container parts assembled by means of these sets of tabs and their lodging places, it is possible to provide rigid lugs or projections that when inserted into female slots act as blocking tabs, thus preventing disassembly of the container after it has been assembled and providing it with the expected structural stiffness.

BRIEF DESCRIPTION OF THE DRAWINGS

To complement the description herein being made and in order to allow a better understanding of the characteristics of the invention, a description is provided with regard to preferred examples of practical embodiments of the same, accompanied as an integral part of said description by a set of drawings, which in an illustrative but non-limitative manner, has been represented the following:

FIG. 1.1 is a plan view showing in detail a transverse side, which is one of the main components of the self-assemblable container.

FIG. 1.2 is a plan view showing in detail a longitudinal side, which is one of the main components of the self-assemblable container.

FIG. 1.3 is a plan view showing in detail a transverse lath, which is an optional component of the self-assemblable container.

FIG. 1.4 is a plan view showing in detail the container's bottom, which is one of the main components of the self-assemblable container.

FIG. 1.5 is a plan view showing in detail the two alternate transverse antisagging braces, which are an optional component of the self-assemblable container.

FIG. 1.6 is a plan view showing in detail the lid, which is an optional component of the self-assemblable container.

FIG. 8.1 shows a perspective view according to a preferred embodiment of the present invention, of a group of assembled containers where it may be noticed that they are aligned for receiving the function of vertical stacking, and exhibit the geometric elements formed for the horizontal blocking function.

FIG. 8.2 shows a perspective view of a group of assembled containers according to a preferred embodiment of the present invention, where their horizontal blocking function may be noticed as they are vertically stacked one on top of the other.

FIG. 9 shows in a plan view a detail according to a preferred embodiment of the present invention, of one of the flexible double tabs of the lateral margins of a smaller side of the container, and that serve to join with the container's larger sides.

FIG. 10 shows in a plan view a detail according to a preferred embodiment of the present invention, of the work exerted by one of the flexible double tabs of the lateral margins of a smaller side of the container with a section of a larger side, at the moment when said flexible double tabs of the smaller side is being inserted into its receiving slot in the larger side.

FIG. 11 shows in a plan view a detail according to a preferred embodiment of the present invention, of the work exerted by one of the flexible double tabs of the lateral margins of a smaller side of the container with a section of a larger side, when said flexible double tabs of the smaller side is already inserted into its receiving slot in the larger side.

FIG. 12.1 shows a plan view of one of the transverse sides of the container according to a preferred embodiment of the present invention, with the necessary modifications to retain and receive the lid or the transverse laths in the case of the container provided with one of these.

FIG. 12.2 shows a plan view of one of the longitudinal sides of the container according to a preferred embodiment of the present invention, with the necessary modifications to retain and receive the lid or the transverse laths in the case of the container provided with one of these.

FIG. 13.1 shows a perspective view of the placing of the transverse lath on the container's smaller and larger sides according to a preferred embodiment of the present invention, showing their position on said container.

FIG. 13.2 shows a perspective view of the securing of the transverse laths on the smaller and larger sides of the container according to a preferred embodiment of the present invention, showing them when they are already installed on top of the container.

FIG. 14.1 shows a perspective view of the lid positioned on top of the smaller and larger sides of the container according to a preferred embodiment of the present invention.

FIG. 14.2 shows a perspective view of the securing of the lid on top of the smaller and larger sides of the container according to a preferred embodiment of the present invention.

FIG. 15.1 shows a perspective view before securing the smaller sides to the bottom of the container according to a preferred embodiment of the present invention.

FIG. 15.2 shows a perspective view after securing the smaller sides to the bottom of the container according to a preferred embodiment of the present invention.

FIG. 15.3 shows a cross-section view along one of the smaller sides of the container according to a preferred embodiment of the present invention, before securing the smaller sides to the bottom.

FIG. 15.4 shows a cross-section along one of the smaller side of the container according to a preferred embodiment of the present invention, after securing the smaller sides to the bottom.

FIG. 16.1 shows a perspective view of a preferred embodiment of the present invention before securing the larger sides of the container to the smaller sides and to the bottom.

FIG. 16.2 shows a perspective view of a preferred embodiment of the present invention after securing the larger sides of the container to the smaller sides and to the bottom.

FIG. 16.3—shows a cross-section view along one of the smaller sides of the container according to a preferred embodiment of the present invention, before securing the larger sides to the smaller sides and to the bottom.

FIG. 16.4 shows a cross-section view along one of the smaller sides of the container according to a preferred embodiment of the present invention, after securing the larger sides to the smaller sides and to the bottom.

FIG. 17.1 shows a plan view of a longitudinal side of the container according to a preferred embodiment of the present invention, with the necessary modification in the longitudinal side for the effective implementation of the seat when the container is to provide on the lid the additional function of an antisagging brace.

FIG. 17.2 shows a plan view of the additional lid of the container according to a preferred embodiment of the present invention, with the necessary modification in its larger edges for the effective implementation of the seat when the container is to provide on the lid the additional function of an antisagging brace.

FIG. 18.1 shows a perspective view of a finished container according to a preferred embodiment of the present invention, made so as to hold its corresponding lid when said lid has the additional function of an antisagging brace on the larger sides.

FIG. 18.2 shows a perspective view of a finished container according to a preferred embodiment of the present invention, with its corresponding lid placed and secured when said lid has the additional function of an antisagging brace on the larger sides.

FIG. 26.1 shows a perspective view of a finished container according to a preferred embodiment of the present invention that incorporates the transverse antisagging brace when the transverse sides further incorporate the function of visioning or ventilating the contents of the container through the same, the perspective view showing a detail of its positioning prior to placement of said transverse antisagging brace.

FIG. 26.2 shows a perspective view of a finished container according to a preferred embodiment of the present invention that incorporates the transverse antisagging brace when the transverse sides further incorporate the function of visioning or ventilating of the contents of the container through the same, the perspective view showing a detail of its positioning after placement of said transverse antisagging brace.

FIG. 27.1 shows a perspective view of a finished container according to a preferred embodiment of the present invention that incorporates the transverse antisagging brace and the two transverse laths when the larger sides further incorporate the function of visioning or ventilating the contents of the container through the same, the perspective view showing a detail of their positioning before placement of said transverse antisagging brace.

FIG. 27.2 shows a perspective view of a finished container according to a preferred embodiment of the present invention that incorporates the transverse antisagging brace and the two transverse laths when the larger sides incorporate the function of visioning or ventilation of the contents of the container through them, the perspective view showing a detail of their positioning after placement of said transverse antisagging brace.

FIG. 28.1 shows a perspective view of a finished container according to a preferred embodiment of the present invention that incorporates the transverse antisagging brace without any other additional geometric formation, the perspective view showing a detail of its positioning before placement of said transverse antisagging brace.

FIG. 28.2 shows a perspective view of a finished container according to a preferred embodiment of the present invention that incorporates the transverse antisagging brace without any other additional geometric formation, the perspective view showing a detail of its positioning after placement of said transverse antisagging brace.

FIG. 29.1 shows a perspective view of a finished container according to a preferred embodiment of the present invention that incorporates the transverse antisagging brace and two transverse laths, without any other additional geometric formation, the perspective view showing a detail of their positioning before placement of said transverse antisagging brace.

FIG. 29.2 shows a perspective view of a finished container according to a preferred embodiment of the present invention that incorporates the transverse antisagging brace and two transverse laths, without any other additional geometric formation, the perspective view showing a detail of their positioning after placement of said transverse antisagging brace.

FIG. 30.1 shows a perspective view of several stacked containers according to a preferred embodiment of the present invention wherein their larger sides allow visioning or ventilating the contents of the container through the same and are further provided with the transverse antisagging brace.

FIG. 30.2 shows a perspective view of several stacked containers according to a preferred embodiment of the present invention wherein their larger sides do not allow visioning or ventilating the contents of the container through them and are further provided with the transverse antisagging brace.

FIG. 31.1 shows a plan view of a possible embodiment of the additional lid with orifices or hollows on the surface thereof, said lid being provided with the additional bracing function.

FIG. 31.2 shows a perspective view of a finished container and with the perforated lid already assembled, said lid being provided with the additional antisagging bracing function while the larger sides incorporate the possibility of visioning or ventilating the contents of the container through the same.

FIG. 32.1 shows a plan view of a smaller side according to a preferred embodiment of the present invention wherein an opening in the manner of a handhold has been added.

FIG. 32.2 shows a perspective view of a finished container according to a preferred embodiment of the present invention wherein the openings in the manner of handholds may be seen on the smaller sides.

FIG. 33.1 shows a raised side view of a group of stacked containers according to a preferred embodiment of the present invention, without a lid, without a transverse antisagging brace and without transverse laths.

FIG. 33.2 shows a side view of a group of stacked containers according to a preferred embodiment of the present invention, without a lid, without a transverse antisagging brace and without transverse laths.

FIG. 34.1 shows a raised side view of a group of stacked containers according to a preferred embodiment of the present invention, without a lid, without a transverse antisagging brace and without transverse laths but with the functions of visioning or ventilation of their interior through their larger sides and with the opening in the manner of a handgrip on their smaller sides.

FIG. 34.2 shows a side view, of a group of stacked containers according to a preferred embodiment of the present invention, without a lid, without a transverse antisagging brace and without transverse laths, but with the functions of visioning or ventilation of their interior through their larger sides and with the opening in the manner of a handgrip on their smaller sides.

FIG. 34.3 shows a perspective view of a finished container according to a preferred embodiment of the present invention, without a lid, without a transverse antisagging brace and without transverse laths, but with the functions of visioning or ventilation of their interior through their larger sides and with the opening in the manner of a handgrip on their smaller sides.

FIG. 35.1 shows a raised side view of a group of stacked containers according to a preferred embodiment of the present invention, with a lid, without the transverse bracing function in the same but with the functionality of the opening in the manner of a handhold on their smaller sides.

FIG. 35.2 shows a side view of a group of stacked containers according to a preferred embodiment of the present invention, with a lid, without the transverse bracing function in the same but with the functionality of the opening in the manner of a handhold on their smaller sides.

FIG. 35.3 shows a perspective view of a finished container according to a preferred embodiment of the present invention, with a lid, without the transverse bracing function in the same but with the function of the opening in the manner of a handhold on their smaller sides.

FIG. 36.1 shows a raised view of a group of stacked containers according to a preferred embodiment of the present invention, with a lid provided with the transverse bracing function in the same and without the function of visioning or ventilation of their interior through their larger sides.

FIG. 36.2 shows a side view of a group of stacked containers according to a preferred embodiment of the present invention, with a lid provided with the transverse bracing function in the same and without the function of visioning or ventilation of their interior through their larger sides.

FIG. 36.3 shows a perspective view of a finished containeraccording to a preferred embodiment of the present invention, with a lid provided with the transverse bracing function in the same and without the function of visioning or ventilation of their interior through their larger sides.

FIG. 37.1 shows n raised side view of a group of stacked containers according to a preferred embodiment of the present invention, with a lid with the transverse bracing function in the same and with the function of visioning or ventilation of their interior through their larger sides.

FIG. 37.2 shows a side view, of a group of stacked containers according to a preferred embodiment of the present invention, with a lid with the transverse bracing function in the same and with the function of visioning or ventilation of their interior through their larger sides.

FIG. 37.3 shows a perspective view of a finished container according to a preferred embodiment of the present invention, with a lid with the transverse bracing function in the same and with the function of visioning or ventilation of their interior through their larger sides.

FIG. 38.1 shows a raised side view of a group of stacked containers according to a preferred embodiment of the present invention, with the transverse lath elements and with the functions of visioning or ventilation of their interior through their larger sides and the opening in the manner of a handhold in their smaller sides.

FIG. 38.2 shows a side view of a group of stacked containers according to a preferred embodiment of the present invention, with transverse lath elements and with the functions of visioning or ventilation of their interior through their larger sides and the opening in the manner of a handhold in their smaller sides.

FIG. 38.3 shows a perspective view of a finished container according to a preferred embodiment of the present invention, with transverse lath elements and with the functions of visioning or ventilation of their interior through their larger sides and the opening in the manner of a handhold in their smaller sides.

FIG. 39.1 shows a raised side view of a group of stacked containers according to a preferred embodiment of the present invention, with transverse lath and transverse antisagging bracing elements, without the functions of visioning or ventilation of their interior through their larger sides and with the opening in the manner of a handhold in their smaller sides.

FIG. 39.2 shows a side view of a group of stacked containers according to a preferred embodiment of the present invention, with transverse lath and transverse antisagging bracing elements, without the functions of visioning or ventilation of their interior through their larger sides and with the opening in the manner of a handhold in their smaller sides.

FIG. 39.3 shows a perspective view of a finished container according to a preferred embodiment of the present invention, with transverse lath and transverse antisagging bracing elements, without the functions of visioning or ventilation of their interior through their larger sides and with the opening in the manner of a handgrip in their smaller sides.

FIG. 40.1 shows a raised side view of a group of stacked containers according to a preferred embodiment of the present invention, with transverse lath and transverse antisagging bracing elements, and additionally, with the functions of visioning or ventilation of their interior through their larger sides and the opening in the manner of a handgrip in their smaller sides.

FIG. 40.2 shows a side view of a group of stacked containers according to a preferred embodiment of the present invention, with transverse lath and transverse antisagging bracing elements, and additionally with the functions of visioning or ventilation of their interior through their larger sides and with the opening in the manner of a handgrip in their smaller sides.

FIG. 40.3 shows a perspective view of a finished container according to a preferred embodiment of the present invention, with transverse lath and transverse antisagging bracing elements, and additionally with the functions of visioning or ventilation of their interior through their larger sides and with the opening in the manner of a handgrip in their smaller sides.

DESCRIPTION OF THE PREFERRED EMBODIMENTS OF THE INVENTION

Figure 2:
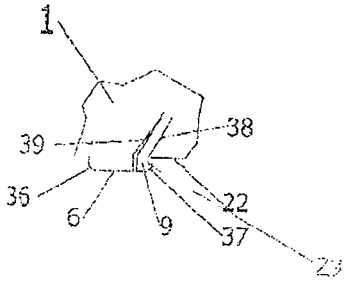
FIG. 2 is a plan view according to a preferred embodiment of the present invention showing in detail one of the flexible tabs of the bottom used for joining said bottom to the larger sides of the container.

The self-assemblable container for generic use, preferably manufactured exclusively from ecologic, renewable and biodegradable materials of the present invention, as it shall be explained in the present document, solves at least in part the previously mentioned problems.

As the container's structural elements are obtained by a laser cutting method, their perimetrical faces are perfectly sealed and cauterized, thus avoiding moisture penetration though the edges to the core of the same.

The main independent structural elements for the construction of this container, as described in FIGS. 1.4 through 1.6, are a bottom (1), two larger or longitudinal sides (2)(2') and two smaller or transverse sides (3)(3') In addition, and as it shall be explained below, in certain preferred embodiments it may be provided on top with a possible lid (4), a possible antisagging transverse brace (5*a*)(5*b*) with two geometric configurations and/or two transverse laths (70)(70'), the installation of these last three elements being optional as it has been mentioned, and said lid being configurable to perform in addition to its upper closure function, that of an antisagging brace and transverse laths.

All these members are assembled together by means of different non-return pin clip systems arranged along their perimeter, consisting of a specified number of flexible tabs (6) (9) (7) (10) (8) (11) that, when entering into their lodging places formed by rectangular receiving slots or orifices (12) (13) (14) that perform the function of receiving female part for said flexible tabs, ensure structural stability to the arrangement thanks to the tensile work exerted between them. In addition and to prevent displacement between the components assembled by these sets of flexible tabs and lodging places, rigid rectangular lugs or projections (15) (16) are provided that, when inserted into female rectangular receiving slots or orifices (17) (18), work as blocking lugs, the whole set of these elements preventing in this manner disassemble of the container after it as been put together and providing the expected structural stiffness.

As shown In FIG. 1.4, bottom (1) basically consists of a rectangular component obtained by laser cutting of its entire contour, the rectangular piece being geometrically symmetric from its larger edges (22) and its smaller edges (19) to its two central axes or mediatrices (a) (a'). Some rectangular slots (12) in an even number and variable number depending on the size of the container have been made along its smaller edges (19) equally spaced and at a reasonably short distance from said edges (19). These slots will serve as female or receiving slots for the flexible tabs (7) (10) that stand out from lower edge (34) of the smaller sides (3) (3'), and will be used for locking these components (3) (3') perpendicularly to bottom (1). On bottom (1) and near to both smaller edges (19) and on the same longitudinal line where the above described rectangular slots (12) are placed, there are other two rectangular slots or orifices (20), wider and possibly of a different length relative to the others, and arranged at the intermediate free space left between the first and the second receiving slots (12) as counted from both ends. These two pairs of additional slots (20) will serve as receivers or lodging places for two semicircular retention flaps (21) that stand out from the upper edge (35) of the container's smaller sides (3) (3') and, in the case when the containers are stacked one of on top of the other, they shall vertically block into position the containers and prevent a horizontal displacement thereof in any way or direction.

A varying number of flexible tabs (6) (9) stand out from the larger edges (22) of the bottom (1) longitudinally to said larger edges (22) and equidistantly placed from each other, these flexible tabs (6) (9) having a rigid area or projection of rectangular geometry (6) and being provided in one of their outer corners with a triangular fluke-like projection which is part of the flexible area (9) of these tabs. The configuration of these flexible tabs may be observed in detail in FIG. 2.

This set of flexible tabs (6)(9) that stand out from the larger edges of bottom (1) comprise a rectangular projection (6) with a stand out portion measuring always higher than the thickness of the material used to make the larger sides (2) (2') that will contain the receiving slots or orifices in the manner of female parts (13) for said flexible tabbed ends tabs. Said receiving slots or orifices (13) located on the larger sides (2) (2') of the container will have a length equal to the length of the standing out projection configured for the flexible tab and a width equal to the thickness of the material used to make bottom (1).

The rigid area (6) of these flexible tabs has at its outer corner a chamfer (36) that will aid in its positioning and as a reference over the receiving slot or orifice (13) located on the larger sides (2) (2') of the container. The outer corner of the flexible tab that is opposite to the corner of the rigid area where said chamfer (36) has been made and that has a flexible configuration, is also provided with a chamfer (37) of a defined radius. The latter chamfer precedes a triangular retention fluke (23) which stands out laterally and outwardly from the flexible tab, performing a retaining function to resist withdrawal after the flexible tab described herein has been lodged in its receiving slot (13) located on the container's larger sides (2) (2').

Two cuts (38) (39) are made to impart sufficient flexibility to the flexible area (9) of the described flexible tab and, when the set of flexible tabs are inserted in the slot (13), allowing the retention fluke not to be damaged or affected by distortions that might weaken its subsequent tensile work and resistance to withdrawal after being inserted. These first of these two cuts (38) (39) starts perpendicular to the flexible tab's outer face and then runs parallel to the other cut at a distance and length one (38) from the other (39) toward the interior of bottom (1), said distance and length depending on the flexion modulus admitted by the raw material used to make bottom (1), and said cuts (38) (39) taking a direction that generates an acute angle with the larger edge (22) of bottom (1) as it is clearly shown in FIG. 2.

The first of these cuts (39), generates a triangular hollow out similar to a "V", wherein the open area of said "V"-shaped cut (39) is oriented towards the flexible tab's outer face (6) and the size of the outer opening of said "V" (39) shall be equivalent to the expected flexion yield of the flexible tab (6) (9) when it is inserted into its rectangular slot (13) located on the larger sides (2) (2') of the container. The second cut (38) is made parallel and colinear to the "V" shaped cut (39) until it meets the larger edge (22) of bottom (1), such being an area where the retention fluke has been configured. The area delimited by both cuts (38) and (39) configures the flexible tab (6) (9).

Figure 3:
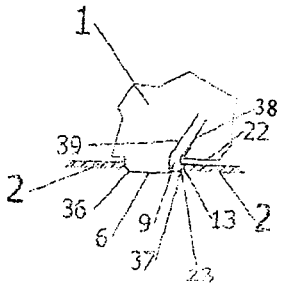
FIG. 3 is a plan view according to a preferred embodiment of the present invention showing in detail the work exerted by one of the flexible tabs of the bottom of the container with a section of a larger side of the container, at the moment when said flexible tab of the bottom is inserted into a receiving slot of the larger side.

For further details of the work carried out by the herein explained flexible tabs (6) (9), FIG. 3 shows a plan view and a cross-section view of a larger side (2) (2') showing the flexural work exerted by said flexible tabs (6) (9) when facing their receiving slots (13). For this purpose a detail of a section of the container's bottom (1) and of a larger side (2) of the container is shown when the entire flexible tab (6) (9) is entering into its receiving slot (13). When the flexible tabs (6) (9) coining from the bottom (1) and formed by a rigid area (6) and a flexible area (9) face and are pressed into their homologous rectangular slots (13) made in the container's larger side (2) (2'), the outer corner chamfers (36) (37) of said flexible tabs help with the correct centering over the receiving slot (13) and subsequently the face of the chamfer (37) located on the outside corner of the flexible area (9) and preceding the retention fluke (23) comes into contact with the inner lateral face of slot (13). Since the total length of this slot (13) is shorter than that occupied by the area bounded by chamfers (36) (37), it presses the retention fluke inwardly. This pressure forces the flexible tab to flex in the opposite direction, an action that is made possible because of the free space left by the above mentioned "V"-shaped cut (39) and that sees its space occupied by the flexural movement of the flexible area (9) of the herein-described flexible tab. As shown in FIG. 3, said flexion is made possible by the cut (38) made on the flexible area (9) of the flexible tab, that frees its space at the moment of flexure. The retention fluke passes through rectangular slot (13) without being damaged, owing to the great hardness and the cauterization that its perimetrical faces have acquired thanks to the laser cutting method employed according to the present invention when forming bottom (1).

Figure 4:
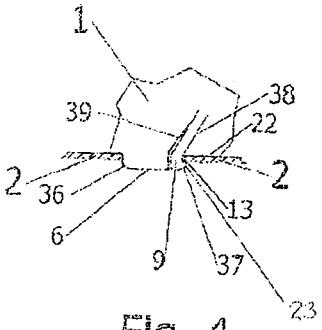
FIG. 4 is a plan view according to a preferred embodiment of the present invention showing in detail the work exerted by one of the flexible tabs of the bottom of the container with a section of a larger side of the container, when said flexible tab of the bottom is already assembled in its receiving slot in the larger side.

As shown In FIG. 4, once the retention fluke passes over the outer face of the larger side (2) of the container, when entering into its rectangular receiving slot (13), the flexible arrangement (9) of the herein described flexible tab returns to its original position as this area (9) is unable to surpass the flexural limits allowed by the raw material, the arrangement (9) therefore not reaching its breaking point due to the configuration imparted by cuts (38) (39), so that the retention fluke is placed with its inner face in contact with the outer face of the larger side (2), thereby performing the non-return function and preventing withdrawal of the entire flexible tab (6) (9) arrangement from its rectangular slot (13) after being inserted, thus ensuring the tensile resistance of said joint. In addition, cuts (38) (39) are conveniently used as openings for the inner refrigeration and ventilation of the container through its bottom (1), and said bottom does not necessarily require additional slots or openings for this purpose. This flexible tab arrangement (6) (9) that stands out from the larger edges (22) of the bottom (1) is used for bracing and locking the container's larger sides (2) (2') to the bottom (1).

It may be noted in FIG. 1.4 that four rectangular lugs (15) protrude near to the four outer corners and stand out from the larger edges (22) of bottom (1), each one located at each corner so as to perform the function of blocking lugs, as they shall be placed in front of the rectangular slits slots (17) provided on the container's larger sides (2) (2') and punched therein to act as female part for such purpose, and will perform together a blocking function to prevent the bottom (1) and larger sides (2) (2') from sliding between each other when they have been anchored to the container structure.

FIG. 1.2 shows the member that will form the container's two larger sides (2) (2') obtained by laser cutting, preferably from MDF or HDF fiberboard. It basically consists of a rectangular member provided with rectangular slots or slits orifices (13) (14), strategically positioned and sized to receive the flexible tabs respectively projecting from the bottom (1) and smaller sides (3) (3') of the container.

Along the lower edge (28) of the container's larger side (2) (2') and equally spaced apart, there are several rectangular slots or orifices (13), equal in number to the flexible tabs (6) (9) on the larger edges of bottom (1), these slots (13) being of the same size as said flexible tabs (6) (9) and being positioned to coincide with these flexible tabs (6) (9) so that when both parts face one another they will coincide one within the other.

On the same longitudinal axis on which said slots (13) are located and near to the left (30) and right (29) edges of the container's larger sides (2) (2'), there are two rectangular slots (17), one for each edge, that serve to receive the standing out rectangular lugs (15), that work as mechanic blocking pins, of the bottom's (1) larger edges (22). When the container is being assembled, said slots (17) will receive in the manner of female parts these projecting rectangular lugs (15), as in the design these are already positionally aligned with the same, performing alltogether the blocking function to prevent the larger sides (2) (2') and bottom (1) from sliding between each other after they have been anchored to the container's structure, as explained above.

Parallel to the right (29) and left (30) edges of the larger side (2) (2') of the container and vertically placed thereon, we find a group of equally spaced apart rectangular slots or orifices (14). Another rectangular slit slot (18) has been opened in the same longitudinal axis of this group of rectangular slots or orifices (14) and at the center of each space delimited by said slots. Said rectangular slots (14) and rectangular slot (18) serve as receivers or lodging places for the flexible double tabs (8) (11) and for the blocking lugs (16), respectively, and which are made for such purpose on the left (32) and right (31) edges of the smaller sides (3) (3') of the container.

On the upper edge (33) of the larger sides (2) (2') of the container, and near the smaller edges (29) (30) thereof, there are two semicircular vertically-standing out projections or flaps (75) that, since being correspondent with respective semicircular cutouts or hollow outs (76) made on the lower edge (28) of the container's larger sides (2) (2'), are used for generating a blocking system when the containers are vertically stacked one on top of the other, after being assembled.

These semicircular projections (75) located on the upper edge (33) of the larger sides (2) (2') coincide both in position and in geometric shape with said semicircular cutouts (76) made on the lower edge (28) of the larger sides (2) (2'), thereby performing between them the male part and female part function, this function being the one that provides a blocking capacity against longitudinal displacements of some containers over others when they have been vertically stacked in their finished configuration.

Equidistant flexible tabs (7) (10) stand out from the lower edge (34) of smaller sides (3) (3'), these flexible tabs in a position and number that coincides with the number of rectangular slots or orifices (12) made to receive them in bottom (1) Said flexible tabs (7) are, equally to those described for bottom (1), flexible tabs having a geometry that is rectangular and being provided in one of their outer corners with a fluke-like projection.

Figure 5:
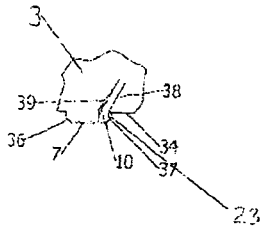
FIG. 5 shows in plan view a detail according to a preferred embodiment of the present invention, of one of the flexible tabs in the lower edge of a smaller side of the container, used for joining said smaller side to the bottom of the container.

For a better understanding of the work exerted by said flexible tabs (7) (10) located on the lower edge (34) of the container's smaller sides (3) (3'), a clear detail is shown in FIG. 5.

These flexible flexible tabs (7) (10) located on the lower edge (34) of the container's smaller sides (3) (3'), exert work that is similar to that of the previously detailed flexible tabs (6) (9) located on the larger edges (22) of bottom (1).

A chamfer (36) has been made on the outer corner of the rigid area (7) of said flexible tabs to facilitate the correct positioning of the set of flexible tabs (7) (10) over the set of rectangular receiving slots (12) located along the smaller edges (19) of bottom (1), when the operation or pressure is made on the shorter sides (3) (3') in order to anchor them to bottom (1).

On these flexible tabs (7) (10) two cuts (38) (39) have also been made that delimit the flexible area (10), but although these cuts (38) (39) are parallel to each other and have between them a distance and a length that depends on the flexion modulus of the raw material used to make the smaller sides (3) (3') of the container, they are not perpendicular to the outer face of the herein described flexible tabs. The cut (38) that will allow to configure the flexible area (10), starts at the inner vertex generated by the confluence of the lower edge's (34) line of the container's smaller sides (3) (3') with the standing out face of the flexible tab on which a retention fluke (37) is placed and that shall configure said flexible area (10) This cut (38) runs into the container's smaller side (3) (3') forming an acute angle with lower edge (34) and oriented in the same direction as the retention fluke that stands out from flexible area (10) of the herein described flexible tab.

The other cut makes a hollow out (39) that starts at the outer face of the flexible tab and runs perpendicular to said face until it joins with the line or axis delimited by lower edge (34). From this point on, the cut or hollow out (39) acquires the same slant as its above-described supplementary cut (38), running parallel to the same, but gradually getting closer in the shape of a "V" until both inner faces of said cut (39) are joined at a point where it ends, having, in short, the same length as the supplementary cut (38).

The space or hollow out left by cut (39) in the confluence with the herein described flexible tab's outer face will be of sufficient width as to allow, under the flexural effort made on flexible area (10) of the herein described flexible tab, sufficient withdrawal of the retention fluke located on the flexible area (10) as to pass through its rectangular receiving slot (12) without causing breakage, deformation or dimensional instability of said fluke.

The cuts (38) (39) are made at the above described angle to avoid a possible conflict or confluence of the same with cuts (41) made to obtain the expected flexion over the flexible double tabs (8) (11) located on the right and left edges (31) (32) of the container's smaller sides (3) (3').

In addition, cuts (38) (39) are conveniently used as openings for the refrigeration and inner ventilation of the container through its smaller sides (3) (3), the containers not needing additional openings to obtain this effect. The set of flexible tabs (7) (10) that stand out from the lower edge of smaller sides (3) (3') are in short, used to brace and anchor the container's smaller sides (3) (3') to bottom (1).

Figure 6:
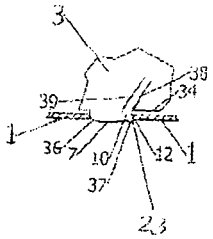
FIG. 6 shows in plan view a detail according to a preferred embodiment of the present invention, of the work exerted by one of the flexible tabs of the lower edge of a smaller side of the container with a section of the bottom, at the moment when said of the shorter side is inserted into its receiving slot in the bottom.
Figure 7:
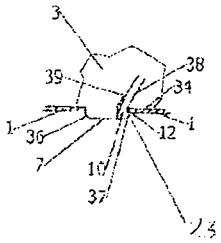
FIG. 7 shows in plan view a detail according to a preferred embodiment of the present invention, of the work exerted by one of the flexible tabs of the lower edge of a smaller side of the container with a section of the bottom, when said flexible tab of the smaller side is already assembled in its receiving slot in the bottom.

FIGS. 6 and 7 show a clear detail of the work exerted by flexible tabs (7) (10) that stand out from the lower edge (34) of the container's smaller sides (3) (3'), FIG. 6 representing a detail or cross-section of the positioning and insertion of said tabs (7) (10) over their receiving slots (12) and FIG. 7 representing a clear detail or cross-section of said flexible tabs (7) (10) final position when they have completed their insertion over their receiving slots (12) located on the bottom (I), so that the retention fluke is placed with its inner face in contact with the lower face of bottom (1), thereby performing a non-return function and preventing withdrawal of the whole flexible tab set (7) (10) from their rectangular slots (12) after they have been inserted, ensuring the tensile resistance of said coupling.

As shown in FIG. 1.1 two semicircular recesses (40) are formed in the intermediate spaces existing between the first and the second projection or flexible tab (7) (10) of the lower edge (34) of the smaller sides (3) (3') of the container, as counted from outside the right (31) and left (32) edges. These two semicircular recesses (40) have been formed as a semicircular arc, matching in radius and position with the two semicircular flaps (21) that stand out from the upper edge (35) of the container's smaller sides (3) (3'). Said recesses (40) and flaps (21) are used to support, fit in and anchor the already assembled containers when vertically stacked one on top of the other.

When the containers are assembled and vertically stacked one on top of the other, said flaps (21) that stand out beyond the limit of the upper edge (35) of the smaller sides (3)(3') pass through the rectangular slots (20) made for that purpose in bottom (1) and are supported in the semicircular recesses (40) made in the lower edge (34) of smaller sides (3) (3'), thus blocking horizontal movements in any way and direction, keeping the containers vertically stacked and ensuring the necessary perimetrical contact between them to transfer to their sides (2)(2')(3)(3') the vertical loads originated in said stacking process. The width of the rectangular slots or orifices (20) made in bottom (1) to obtain this blocking effect shall be relative to the amount of tolerance desired to impart to a possible longitudinal displacement of the upper container when stacked one on top of another.

FIGS. 8.1 and 8.2 clearly show detailed views of the orientation and blocking effect obtained with the entire arrangement comprising said flaps (21), lodging places (20) of these flaps, semicircular supporting recesses (40), semicircular projections (75) on the larger sides (2)(2') and lodging places (76) of these projections, when vertically stacking two containers one on top of the other.

As it is also shown in FIG. 1.1, securing elements (8) stand out from the right (31) and left (32) edges of the smaller sides (3)(3') in the manner of flexible double tabbed ends (11) in the same number and positioned as to correspond with the rectangular slots or orifices (14) existing on the left (30) and right (29) edges of the larger sides (2)(2') of the container.

As it is also shown in FIG. 1.1, securing elements stand out from the right (31) and left (32) edges of the smaller sides (3) (3') in the manner of flexible double tabs (8) (11) in the same number and positioned as to correspond with the rectangular slots or orifices (14) existing on the left (30) and right (29) edges of the larger sides (2) (2') of the container.

As shown in detail in FIG. 9, these flexible and double tabbed projections (8) (11) are formed with a shape similar to an arrow head perpendicularly oriented towards the outside of the lateral edge where they are placed, with their point blunted or outer face (8) chamfered, and provided with cuts (41) These cuts (41) are strategically placed as a prolongation of the arrow body (11) of the flexible double tabs and are directed towards the inner portion of member (3) (3'), and allowing flexion of the pair of flexible double tabs (8) (11) towards their central axis©, thanks to the creation of a "V" shaped triangular hollow out (42), with its open area centered on the outer face (8) of the defined flexible tab and its opposite vertex oriented inwards. These flexible double tabs (8) (11) will be configured by the material existing between both cutouts (41) and the "V" shaped hollow out (42). This "V" shaped hollow out (42) provides a supplementary solution for the inner ventilation of the finished container's interior through the smaller sides (3) (3'), given its homogeneous distribution over the right (31) and left (32) edges of said smaller sides (3) (3').

The outer corners of the flexible double tabs (8) (11) to which reference is herein being made, are configured with respective rounded chamfers (43) to help in the correct positioning of flexible double tabs (8) (11) the over its receiving slots (14) located on the larger sides (2) (2'), before pressure is exerted for their insertion. These chamfers (43) end In two triangular flukes (44) that stand out laterally from said flexible double tabs (8) (11) and are used as a retaining or non-return element once inserted through the rectangular receiving slots (14) located on the left (30) and right (29) edges of the larger sides (2) (2') of the container.

The herein described "V" shaped hollow out (42) has an opening in its outer area equivalent to the necessary free space so that when both flexible double tabs (8) (11) that make up the arrangement have been flexed towards their central axis©, they may allow retention flukes (44) to pass through rectangular slot (14) present on edges (30) (29) of the larger sides (2) (2') of the container without being broken or deformed.

FIG. 10 clearly explains by means of a cross-section plan view the work exerted by these flexible double tabs (8) (11) when they are positioned and pressed over their rectangular receiving slots (14) present on edges (30) (29) of the container's larger sides (2) (2'), showing the maximum flexion point of the flexible double tabs (8) (11) when entering into said slots (14).

FIG. 11 shows in detail, by means of a cross-section plan view, the final arrangement of said flexible double tabs (8) (11) once retention flukes (44) have passed through the rectangular receiving slots (14) located on edges (30) (29) of the container's larger sides (2) (2'). As it may observed, retention flukes (44) return to their original position when pressure is released and the flexible elements (8) (11) do not exceed their maximum flexion modulus and they do not reach their breaking point. The inner faces of the retention flukes (44) are left in contact with the outer face of the larger sides (2) (2') of the container, thereby exerting tensile work upon any attempt made to withdraw them from their lodging place, and preventing disassembly of the arrangement.

As it may be seen again in FIG. 1.1, some small rectangular lugs (16) also stand out from the right (31) and left (32) edges of the smaller sides (3) (3') of the container, at the free space left between each of the standing out double flexible tabs (8) (11), projecting from said edges (31) (32) in a measure equivalent to the width of the raw material used to manufacture the container's larger sides (2) (2'), and coinciding in length, position and number with the previously explained lodging places or rectangular slots (18) made on the left (30) and right (29) edges of the container's larger sides (2) (2'). These rectangular lugs (16) perform the function of mechanical blocking pins that prevent possible movements and displacements of the smaller sides (3) (3') with respect to the container's larger sides (2) (2'), when it has been assembled.

FIG. 12.1 shows in plan view additional geometric formations performed on smaller sides (3)(3'), and FIG. 12.2 shows the additional geometric formations performed on larger sides (2)(2'), in the case of a configuration as the one proposed by the present invention, of a finished container with a retaining seat both to receive two transverse laths (70) (70') and to provide a seat and retention for a container configuration with a lid (4).

Starting from the right and left edges (31) (32), rectangular recesses (45) of the same length are made on the upper edge (35) of smaller sides (3) (3') until the base of the retention flaps (21) (21') is reached, leaving in their middle an unrecessed rectangular area that will form a projecting lug (46) used to fix and retain transverse laths (70) (70') or lid (4) by reason of coincidence in position and size with the rectangular lodging places (72) (72') made for such purpose on said transverse laths (70) (70') and/or with the rectangular lodging places (55) (55') made for such purpose on lid (4).

A recess (47) is also made at the center of the upper edge of the container's smaller sides (3) (3'), in between the bases of retention flaps (21) (21'), said center having again an unrecessed rectangular area that will define a standing out rectangular lug (48) that will serve to secure and retain the center point of transverse laths (70) (70') and/or lid (4). For this purpose, a rectangular slit slot (74) has been made on said laths (70) (70'), positionally located on said laths in size and shape to receive in the manner of a female part the central lug (48) defined on smaller sides (3) (3'). Further, on lid (4) rectangular slots (50) have been made for this same purpose, positionally located on said lid (4) in size and shape to receive in the manner of a female part the central lug (48) defined on smaller sides (3) (3').

Similarly, and in order to retain and secure transverse laths (70) (70') or the optional lid (4) to larger sides (2) (2'), recesses (49) (49') are made on the upper edge (33) thereof, as shown in FIG. 12.2, starting from the corners and towards the inner part of the upper edge and past the area occupied by semicircular projections (75) that will serve to fit in both transverse laths (70) (70') and the optional lid (4) In the case of optionally using transverse laths (70) (70'), the semicircular lugs or projections (75) of the larger sides (2) (2') that are generated when making recesses (19) (49') perform the function of male pins, being coincident in size and position with slots (71) (71') made for said purpose as receiving female part in the transverse laths (70) (70').

In the case of using the herein proposed additional geometric formations on the smaller (3) (3') and larger (2) (2') sides of the container to retain optional lid (4) that is clearly shown in FIG. 1.6, the lugs (46) (46') (48) on the upper edge of smaller sides (3) (3') will correspond with the rectangular slots (55) (55') (50) made for this purpose on lid (4) In the manner of female parts to receive said lugs projected from both smaller sides (3) (3'). The semicircular projections (75) of the larger sides (2) (2') will equally coincide in size and shape with their respective rectangular slots (54) (54') located along the larger edges of lid (4).

It should be noted that in this geometric configuration, as shown in FIGS. 12.1 and 12.2, where the container may additionally be provided with supporting fit in features for the transverse laths (70)(70') and/or the optional lid (4), both the recesses (45)(47) made on the smaller sides (3)(3') and their counterparts (49)(49') made on the larger sides (2)(2'), will have a depth equivalent to the thickness of the raw material used to develop the transverse the laths (70) (70') and/or the lid (4).

A perspective view of how transverse laths (70) (70) are positioned on the finished container may be noted in FIGS. 13.1 and 13.2, by making standing out lugs (46) (48) of smaller sides (3) (3') correspond with rectangular slots (72) (74) contained in said transverse laths (70) (70'). Likewise, it may be seen how the standing out semicircular flaps (21) (21') correspond with and project from the slots (73) (73') that are made for such purpose, in the same manner as semicircular projections (75) shall pass and stand out through rectangular slots (71) (71'), thereby securing the entire upper contour of the container when it is finished.

FIGS. 14.1 and 14.2, show a detail in perspective view of the seating and retention of the optional lid (4) on the container's smaller sides (3) (3'), wherein the rectangular lugs (46) (48) of both smaller sides (3) (3') of the container coincide in size and position with rectangular slots (50) (55) (55') made on lid (4) to the effect of functioning as female receivers, and wherein the semicircular flaps (21) (21') standing out from both smaller sides (3) (3') and the semicircular flaps (75) standing out from both larger sides (2) (2') are lodged passing through slots (47) (47') (54) (54') made for such purpose on lid (4), as shown in its final configuration when lid (4) has been installed on the container.

After having detailed the main elements or components of the self-assemblable container according to the preferred embodiments of the present invention, preferably manufactured exclusively from ecologic, renewable and biodegradable materials, and before explaining other possible embodiments of the same with optional and additional components such as lid (4), transverse antisagging brace (5*a*)(5*b*) and transverse laths (70)(70'), details shall be provided as to the relevant operations performed to assemble the basic system consisting of a bottom (1), two larger sides (2)(2') and two smaller sides (3)(3').

This invention proposes the complete assembling of the container's basic components with only two essential pressing operations and without any other type of assistance or external component to secure their joining together and subsequent structural strength thereof.

As shown in FIG. 15.1, first of all the lower edges (34) of smaller sides (3) (3') with their respective flexible tabs (7) are brought face to face with the line of rectangular slots (12) located in bottom (1) near both smaller edges (19) of bottom (1). This vertical and perpendicular facing of the smaller sides (3) (3') with bottom (1) will make each flexible tab (7) of the smaller sides (3) (3') positionally coincident with its corresponding slots (12) in bottom (1). Then a slight pressure is vertically applied on smaller sides (3) (3') to force the insertion of their flexible tabs (7) into the receiving slots (12) in bottom (1), as shown in FIG. 15.2, and due to the work these exert and has been previously explained, these flexible tabs (7) shall be anchored, preventing their subsequent withdrawal.

Said FIGS. 15.1 and 15.2 show a perspective view of both situations, when smaller sides (3) (3') face bottom (1) and when they are already anchored to the same. In each of these views a cross-section is shown along one of the smaller sides, as show in FIG. 15.3 where the work of flexible tabs (7) may be clearly noticed, before and after being anchored to bottom (1), as shown in FIG. 15.4.

As shown in FIG. 16.1 and as the last assembling operation, larger sides (2) (2') are placed facing the elements that have been already assembled together, i.e. the bottom (1) and the smaller sides (3) (3'), seeking with this facing from the outside that all the fastening elements coincide in position, namely the rectangular slots (13) of the lower edge (28) of both larger sides (2) (2') with the flexible tabs (6) (9) of bottom (1), as well as the rectangular slots (14) on the right and left edges (29) (30) of the container's larger sides (2) (2') with their corresponding flexible double tabs (11) that stand out from edges (31) (32) of the container's smaller sides (3) (3').

As shown in FIG. 16.2, when said groups of slots and flexible tabs face one another, pressure is then inwardly applied from the outer faces of larger sides (2) (2') thus interlocking said larger sides (2) (2') with the receiving arrangement resulting in a correctly assembled finished container. After this assembling operation, blocking lugs (15) that are present in bottom (1) and blocking lugs (16) that are present in the container's smaller sides (3) (3') are lodged in their respective rectangular slots (17) and (18) of the container's larger sides (2) (2'), thereby preventing the displacement of components (1) (2) (2') (3) (3') from one another in any way and direction, thus ensuring the stability of the assembly.

Said FIGS. 16.1 and 16.2 show perspective views of both situations, when larger sides (2) (2') are facing bottom (1) and smaller sides (3) (3') and afterwards when they are already anchored to the same. Each of these views is accompanied by a cross-section along one of the smaller sides (3), as shown in FIGS. 16.3 and 16.4, where the work of flexible double tabs (11) and the position of blocking lugs (1) and (16) may be clearly noticed, before and after being anchored to larger sides (2) (2').

Having described the assembling procedure for the container's basic components and returning now to the figures, it is possible to see in plan view the basic shape of the optional and additional elements that will impart a structural and functional added value to the herein described container, said elements being a lid (4), as shown in FIG. 1.6, a transverse antisagging brace (5*a*)(5*b*) in its two possible geometric configurations, as shown in FIG. 1.5, and/or two transverse laths (70)(70'), as shown in FIG. 1.3. According to the various preferred embodiments required of the finished container, these elements will require possible additional geometric modifications to be carried out on larger sides (2) (2') and smaller sides (3)(3') in order to adapt them to the needs of the herein proposed invention, as it shall be explained below.

As shown in FIG. 1.6, the purpose of lid (4) is to fully close the top of the container and said lid is formed mainly from a rectangular member with rounded corners, obtained by laser cutting a MOF or HOF fiberboard and of a length and width the same size as the total outer length and width of the container when assembled. A recess (78) is made on the larger edges (77) of lid (4), in the middle area thereof, the recess (78) being of equal depth on both larger edges (77) and with a size adjusted to obtain an inner width between both larger edges (77), in their recessed area (78) indicated by dimension (J), equivalent to the container's inner width once assembled. Therefore, the area close to the smaller edges (79) of the lid (4) is configured wider, being provided around said area (79) and on both smaller edges with an arrangement of rectangular slots (54) (55) (68) (50) (68') (55') (54') that, upon performing the function of female receivers, shall coincide in size, shape and position with the rectangular lugs (46) (46') (48) that stand out from the upper edges of the container's smaller sides (3) (3'), the semicircular flaps (21) (21') that stand out from the upper edges of the container's smaller sides (3) (3') and the semicircular flaps (75) that stand out from the upper edges of the container's larger sides (2) (2'), when said container has been assembled. The described geometric configuration is valid for the previously-explained larger sides (2) (2') as shown in FIG. 12.2 and the smaller sides (3) (3') as shown in FIG. 12.1, in the case where the container may optionally be provided with a lid (4) or with transverse laths (70) (70').

In FIGS. 14.1 and 14.2 it can be noticed that the arrangement of rectangular lugs and semicircular flaps that stand out from larger sides (2) (2') and smaller sides (3) (3') are adjusted In size, shape and position to the set of rectangular slots (54) (55) (68) (50) (68') (55') (54') made on lid (4) so that in a male and female parts mode may help to position and block lid (4) on top of the container when it has been assembled.

In addition and as shown in the embodiment of FIGS. 12.1 and 12.2 for the case of the geometric option of the container destined to receive the lid (4) or the transverse laths (70) (70'), it must be noted that the measure or size of the unrecessed and apparently standing out area on the larger edges (77) of the herein explained optional lid (4) shall be equal to the size of recesses (49) (49') made on the larger edge (33) of the larger sides (2) (2') of the container, so that when said lid (4) is positioned on the finished and assembled container, said standing out area of the larger edges (77) of the lid (4) will fit into said lodging places (49) (49') formed at both ends of the two larger sides (2) (2').

In detail and additionally to the basic geometry of the container's larger sides (2) (2°) defined in FIG. 1.2, when said container is provided with the herein detailed lid (4) and as shown in FIG. 12.2, two recesses (49) (49') are longitudinally made on the upper edge (33) of the container's larger sides (2) (2') for the purpose of seating lid (4) over the larger sides (2) (2'), these recesses starting from the left (30) and right (29) smaller edges and being of a depth equivalent to the thickness of the raw material used to make lid (4) and of a length equal to the length of standing out areas of the lid's (4) larger edges (77). A seating area is obtained with these recesses (49) (49') where the projections of said lid (4) will fit in the assembled container, while the outer volume of the finished container does not occupy a greater outer space whether said lid is applied or not.

It may be noted in FIG. 14.2 how the lid in this preferred embodiment of the invention tightly closes the container, not allowing to view its contents through any of its outer faces.

In another embodiment according to the present invention, the lid (4) is used with the additional function of acting as a transverse brace that will impart a greater structural strength to the container in the event of a possible sagging or outward flexion of the container's larger sides (2)(2') when interior of the container is subjected to a pressure or the contained load is displaced against said larger sides.

As it is clearly shown in FIG. 17.2, to configure this embodiment two small geometric alterations are made to the lid (4) and the larger sides (2)(2') of the container, as shown in FIG. 17.1. Additional rectangular projections (57) are formed, centred on previously made recesses (78) on the larger edges of lid (4). These standing out projections, which are of a rectangular shape, will stand out a distance equivalent to twice the width of the material used to make the container's larger sides (2)(2'). The length of these rectangular standing out projections (57) will be one sufficient to contain a rectangular slot or orifice (58) in their center within the space delimited by the projection, said slot being of a length equivalent to the length of the rectangular standing out lugs (59) that coincide in position with the upper recess (56) of the larger sides (2)(2'), as it will be explained below. The width of the rectangular slots (58) shall coincide with the thickness of the material used in the manufacture of the larger sides (2)(2') of the container.

The value, resulting distance or inner dimension (k) between the two slots or orifices will coincide with the shortest distance existing between the inner faces of larger sides (2)(2') of an assembled container.

Supplementary to these rectangular slots (58) made on lid (4) and to perform the blocking or transverse bracing function of the container's larger sides (2)(2'), a geometric modification is made on the larger sides (2)(2') of the container, also shown in FIG. 17.1. Two recesses (56)(56') of equal size are made on the upper edges of the larger sides (2)(2'), of a depth equivalent to the thickness of the material used to make lid (4) and at a certain distance to the right and left of the geometrical center of said upper edge. Between both recesses (56)(56') a geometric formation is configured equivalent to a rectangular lug or projection (59) with rounded outer corners to make its positioning easier, the lug coinciding in position in the manner of a male part with the corresponding rectangular slots (58) made in lid (4) and that perform the task of receiving female parts for said projecting lug (59).

This projecting lug (59) stands out from the center between both recesses (56)(56') made as a seat on the upper edge (33) of the larger sides (2)(2') to receive the lid (4), and said projecting lug (59) will stand out in measure equal to the depth of the formed recesses (56)(56') or, in other words, until its outer face is aligned in the same plane as the plane that limits the perimetrical face of upper edge (33) of the container's larger sides (2)(2'). The length of said lug (59) must be identical to the length of the slots (58) made in the manner of receivers of the same on lid (4).

As shown in FIG. 18.1, and for a better understanding of this embodiment of the invention, a perspective view may be seen where, in addition to the fastening elements explained in prior embodiments and that are common to the smaller sides (3)(3'), larger sides (2) (2') and lid (4), the standing out lugs (59) of larger sides (2)(2') shall coincide in position with rectangular slots (58) made in lid (4) upon placing lid (4) on top of a finished container, and when said lid (4) has been fitted into its final position closing the container, as shown in FIG. 18.2, the formed slots (58) block rectangular lugs (59) of the larger sides (2)(2'), thereby preventing flexion or outward sagging of the same through their upper edges (33) as the lid's (4) own body transversely braces the container when it has been closed.

Figure 19:
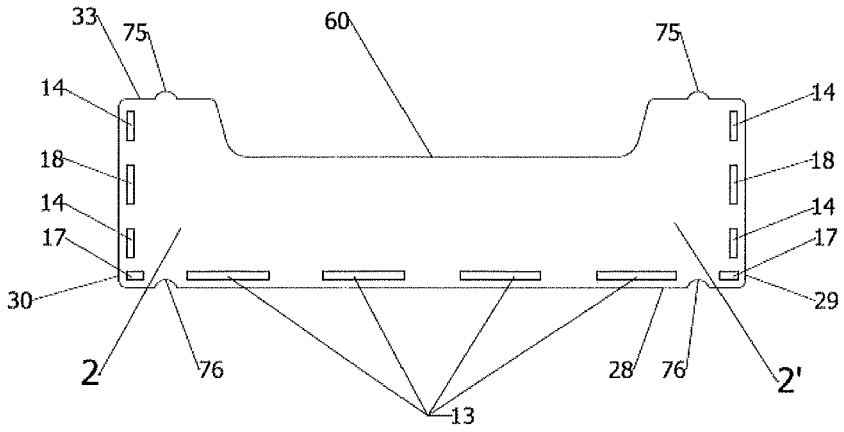
FIG. 19 shows a plan view of a larger side of the container according to a preferred embodiment of the present invention, when it is provided with the appropriate modification to allow visioning or ventilating the contents of the container through the same.
Figure 20:
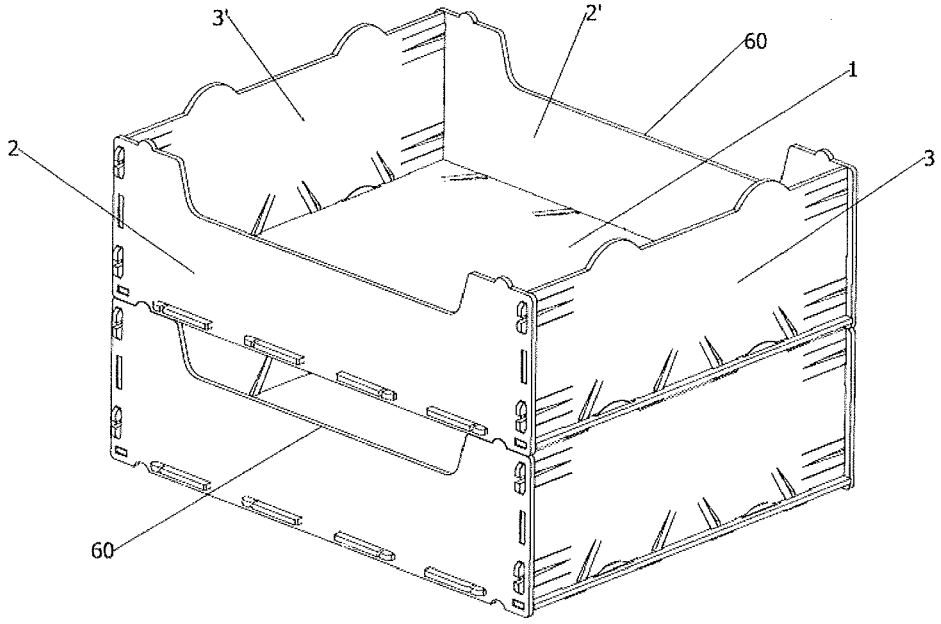
FIG. 20 shows a perspective view of two stacked containers according to a preferred embodiment of the present invention, wherein their larger sides allow visioning or ventilation of the contents of the containers through the same.

In another additional and preferred embodiment according to the present invention, the possibility of visioning the container contents through the larger sides (2)(2') thereof is provided in either its configuration with a lid (4) or without a lid. For this purpose and as shown in FIG. 19, a larger and deeper recess (60) is made on the upper edges (33) of larger sides (2) (2'), taking care of starting it at a reasonable distance from the lateral edges (29)(30); and the inner corners of said recess may be rounded to reduce the aggressive character of the design. The depth of said recess (60) shall delimit the window of access or visioning area of the contents through the container's larger sides (2) (2'). This visioning window additionally helps to aerate and ventilate the contents through the larger sides (2)(2') in a way similar to that of containers commonly used to transport fruits and vegetables. In FIG. 20 it is possible to visualize in detailed the final results of this embodiment in a perspective of a group of vertically stacked containers without a lid (4) and without any additional geometric form to the basic one.

Figure 21:
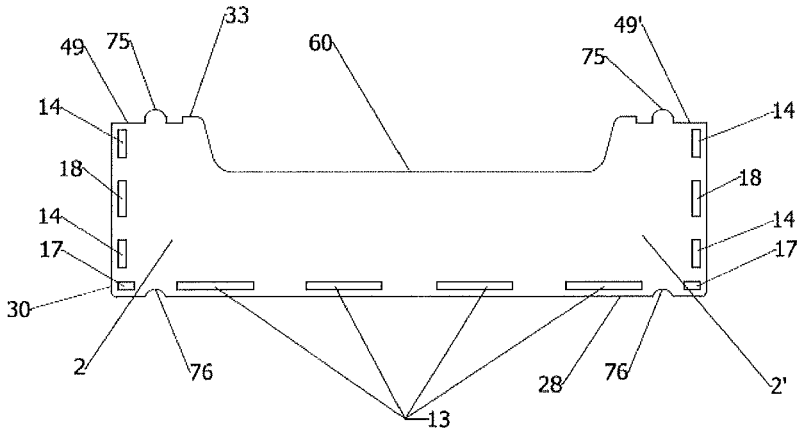
FIG. 21 shows a plan view of a larger side of the container according to a preferred embodiment of the present invention, additionally provided with the appropriate modification to allow visioning or ventilating the contents of the container through the same and further provided with a seat to receive the lid or additional transverse laths.
Figure 22:
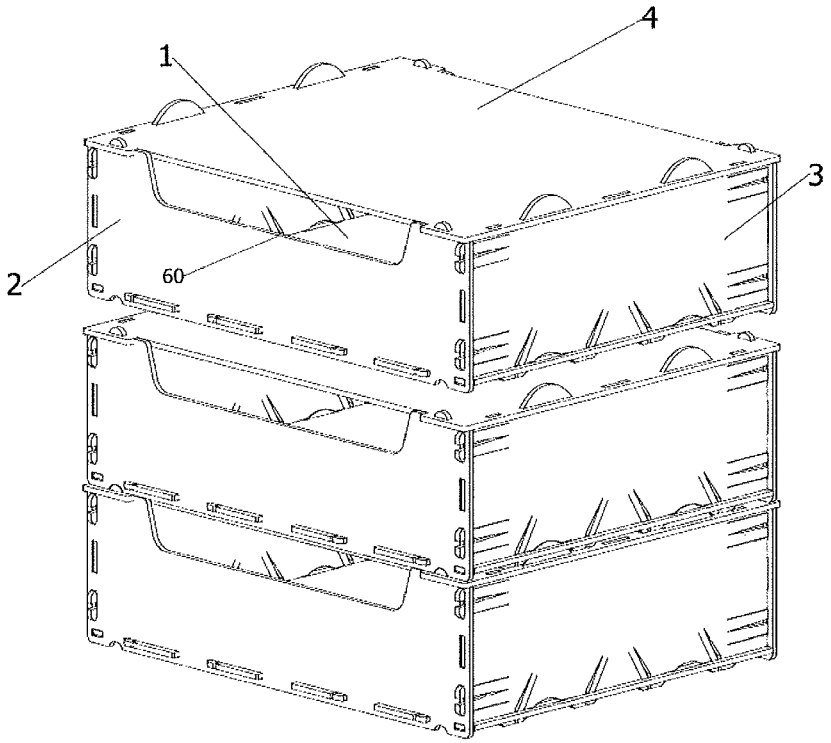
FIG. 22 shows a perspective view of several stacked containers according to a preferred embodiment of the present invention where their larger sides allow visioning or ventilation of the contents of the container through the same and the containers are also provided with lids.

According to another preferred embodiment of the present invention shown in FIG. 21, by combining the geometric configuration resulting from larger sides (2)(2') by intersection and as shown in FIG. 17 and FIG. 19, it may be possible to assemble a container with additional visioning window and lid (4) or transverse laths (70)(70'). In FIG. 22 a detail in perspective view is shown of a group of containers vertically stacked with lids (4) placed and with the function of a lateral window available.

Another possible embodiment of this invention aims to obtain a container with a lid (4) that performs the transverse bracing function as has been previously explained, but further adding the function of a lateral window or the possibility of viewing the contents through its larger sides (2)(2') as already detailed above. To obtain this effect and starting from the geometric forms of the larger sides described in FIG. 21, where already these sides are provided with the recess (49) (49') to lodge the lid (4) in it and the recess (60) that generates the window for viewing the container interior, and as further shown in FIG. 23, a projection is incorporated in the manner of a pillar or trapezoidal tower (61) standing out from the center of the recess (60) up until its upper edge (62) is aligned with the imaginary line of the interior of recesses (49)(49') that serve as a seat for the lid (4). Said upper edge (62) also performs said seat function for the lid in the center of its larger edges, preventing flexion of the same toward the interior of the container when vertical loads are placed over it. Two rectangular projecting lugs (80) stand out from the upper edge (62) of the trapezoidal pillar (61). These will serve for locking and bracing the lid and have been made to obtain the above explained effect for the configuration of the container with a lid (4) that performs the transverse bracing function and that may be observed in detail in FIGS. 17.1 and 17.2.

Figure 24:
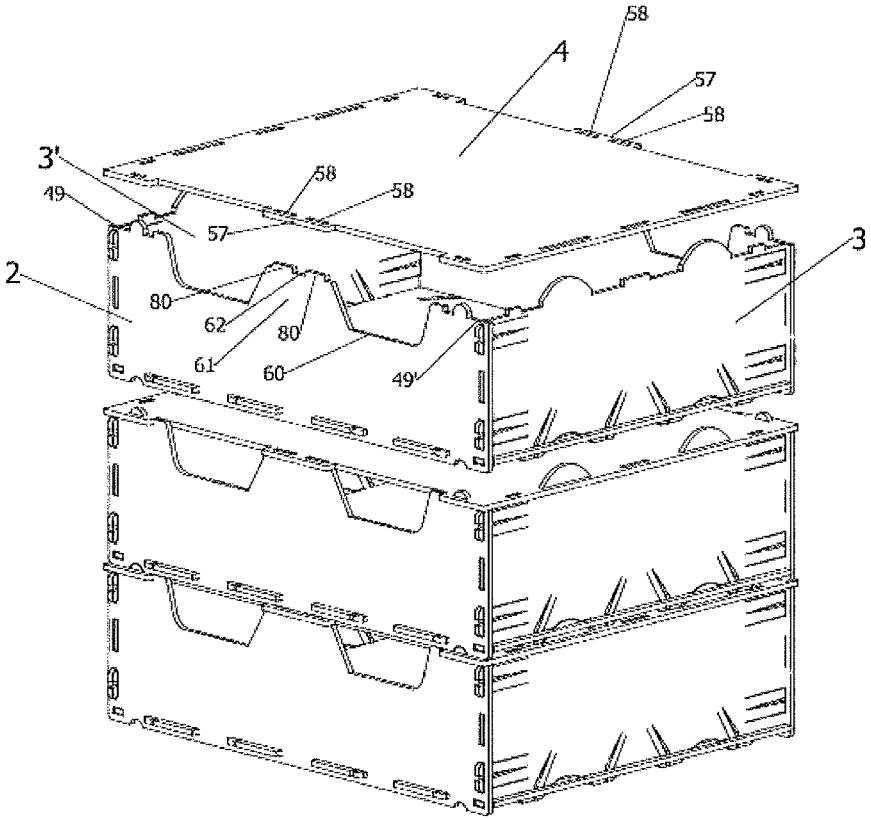
FIG. 24 shows a perspective view of several stacked containers according to a preferred embodiment of the present invention where their larger sides allow visioning or ventilation of the contents of the containers through the same and further provided with a lid that incorporates the transverse antisagging bracing function.

FIG. 24 shows in detail a perspective view of a set of finished and vertically stacked containers, clearly showing the final results of the embodiment provided with a lid (4) and the transverse antisagging bracing function thereof, when larger sides (2) (2') have in addition an area or recess (60) made for easy viewing and ventilation of the contents through them. The transverse bracing effect on the container obtained through the blocking performed by matching and insertion of projecting lugs (80) on the larger sides (2) (2') into slots (58) of lid (4) is of the same type as that explained for prior embodiments and may be clearly seen in FIG. 18.1 with the sole particularity that lid (4) contains two rectangular slits in the manner of slots (58) on each side provide more consistency to the seat formed on larger sides (2) (2') when the latter are fitted into the lugs (80) formed for this purpose on larger sides (2) (2') in this embodiment of the invention.

Another possible embodiment of this invention will provide the possibility of configuring a container without its lid (4) but with the transverse antisagging bracing function (5*a*) (5*b*) both in the case where larger sides (2)(2') incorporate the recess (60) made for visioning or ventilating through the same the container's contents and when these recesses are not incorporated. These embodiments are provided with an additional element having two configurations (5*a*)(5*b*) that are clearly described in a plan view in FIG. 1.5. As may be noticed in said figure, said transverse brace (5*a*)(5*b*) has the purpose of providing the transverse antisagging bracing function in containers that lack an additional lid (4), thereby preventing the flexion or outward sagging produced on the container's larger sides (2)(2') by the effect of pressures produced by the contents being transported or by displacements thereof onto the inner faces of the container's larger sides (2)(2').

As indicated in FIG. 1.5, the antisagging transverse brace is made in its two configurations (5*a*)(5*b*) from a basically rectangular component with rounded corners, obtained by laser cutting MDF or HDF fiberboard, and which greater length is equivalent to the maximum outer width of the container thus being configured and which width is that conferred by the design to provide the expected stiffness in the work it exerts. The transverse antisagging brace is used in its (5*a*) configuration in conjunction with larger sides (2)(2') in their above-explained variant and according to FIG. 23, where two standing out lugs (80) are arranged for the case of the invention where larger sides (2)(2') have a recess (60) made for viewing the container's contents after it has been assembled, as well as to improve inner ventilation of the products.

Therefore, returning to FIG. 1.5, the transverse brace in its (5*a*) configuration is provided with two rectangular slots or orifices (52) parallel and longitudinally placed on each of the two smaller edges (53) of the component, with said slots coinciding in position and size with both lugs (80) that stand out from the center of the upper edge of the container's larger sides (2)(2'), in the configuration modes where an antisagging transverse brace and a recess (60) are made for easy viewing of the container's products, the inner distance (k) between the two pair of slots or orifices being equal to the shortest distance existing between the inner faces of the larger sides (2) (2') of an assembled container.

Figure 23:
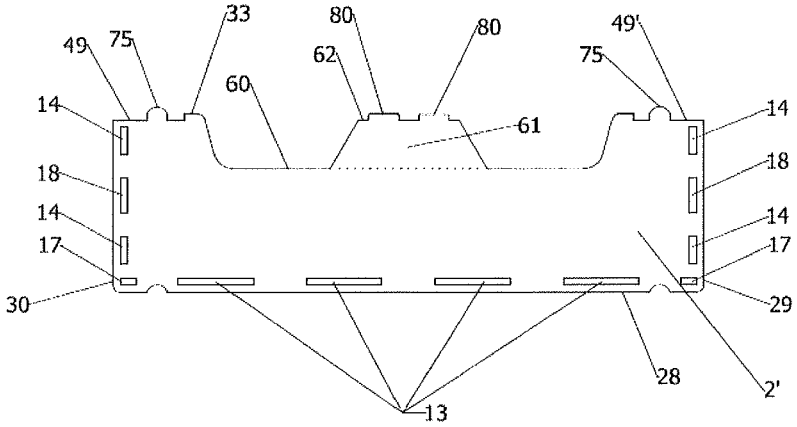
FIG. 23 shows a plan view of a larger side of the container according to a preferred embodiment of the present invention, provided with the appropriate modification to allow visioning or ventilating tho contents of the container through the same and further provided with additional geometric formations to perform the transverse bracing function integrated in the additional lid or in the transverse antisagging brace or transverse laths.
Figure 25:
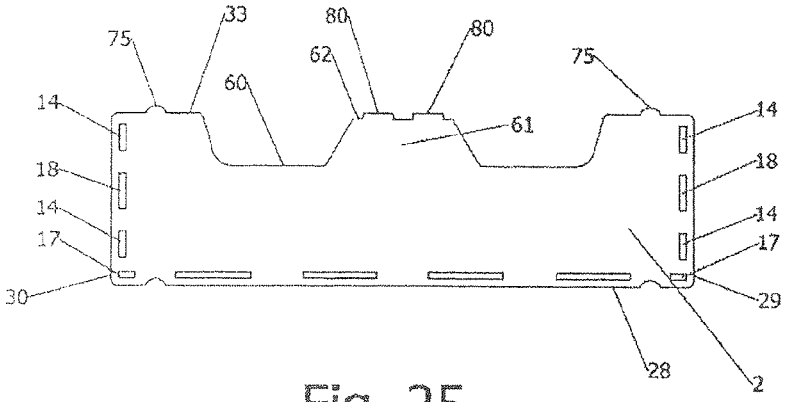
FIG. 25 shows a plan view of a longitudinal side of the container according to a preferred embodiment of the present invention, further provided with the appropriate modification to allow visioning or ventilating the contents of the container through the same and further provided with additional modifications to perform the antisagging bracing function or to support the lid.

As it is clearly shown in FIG. 25 for the embodiment where the transverse antisagging brace (5*a*) will be used it is not necessary to modify the geometric forms created for larger sides (2) (2') in the same case where the lid (4) is used, said two elements using the same anchoring references for the case in discussion, being also possible to include geometric elements (49) made on the larger sides (2) (2'), as shown in FIG. 23, for the case where the container is further provided with the additional configuration of an antisagging transverse brace, and of two transverse laths that may provide further structural stiffness.

This preferred embodiment of the invention allows to use the transverse brace's outer face on top of a finished and assembled container as a display or area for printing and/or marking any type of information concerning the contained product, its origin, breeder, and/or details relative to trademarks and usage details, expiration date or proper manipulation of the product.

FIG. 26.1 shows in a perspective view the insertion in the case of a transverse antisagging brace (5*a*) on top of an already assembled container that is not provided with any additional function and where it clearly shown that the orifices or slots (52) are perfectly aligned over the standing out lugs (80) on the larger sides (2) (2'). which when these are inserted by applying pressure in the manner of male (80) and female (52) parts, as shown in FIG. 26.2, provide the finished container with the expected functionality, this additional function being that of preventing an outward sagging produced by the larger sides' (2) (2') upper edges due to the pressure exerted from within of the container by the contained products.

FIG. 27.1 shows in a perspective view the insertion of optional transverse laths (70)(70') in the case of a container provided with a transverse antisagging brace (5*a*) on an already assembled container further provided with the previously-explained geometric configuration for anchoring the antisagging transverse brace (5*a*). In this figure it is clearly shown that there is no other geometric modification made on the sides that may differ from the case explained above with reference to FIG. 26.1 and in short the arrangement is provided with and even further stiffness and strength, as shown by the assembled set in FIG. 27.2.

In the preferred embodiment where the container is provided with a transverse antisagging brace in its (5*b*) configuration as shown in FIG. 1.5, the same is used as well together with the larger sides (2)(2') in a variant where said larger sides (2)(2') are not provided with recesses or openings made to the effect of viewing the products within the container. The same above explained geometric configuration is therefore used on the larger sides (2) (2') when they receive the lid (4) that includes the antisagging bracing function as shown by FIGS. 17.1 and 18.1. The antisagging transverse brace in its (5*b*) configuration shown in FIG. 1.5, is made as a basically rectangular member with rounded corners, obtained by laser cutting MDF or HDF fiberboard and with its greater length equivalent to the maximum outer width of the container being configured and its width being that given by the design to provide the expected stiffness in the work it exerts. It has a single rectangular slot or orifice (5*b*)-(52) located parallel and longitudinally to each of the two smaller edges (53) of said component, said slots being positioned to coincide and have the same size as the lug standing out from the center of the upper edge of the container's larger sides (2)(2') in the cases of configurations provided with an antisagging transverse brace or a lid (4) and where larger sides (2) (2') are not provided with recesses to allow viewing the interior, as shown in FIG. 17.1.

The width of the antisagging transverse brace in its (5*b*) configuration shown in FIG. 1.5 coincides with the total length between the ends of the recesses (56)(56') made on the upper edge (33) of the container's larger sides (2)(2'), as shown in FIG. 17.1, the standing out lug in the center of said recesses coinciding in position and size with ther rectangular slot (52) made parallel and longitudinal to each of the two smaller edges (53) of the transverse antisagging brace (5*b*).

As shown in the perspective view of FIG. 28.1, when transverse brace (5*b*) is inserted orienting its slots (52) onto its receiving lugs (59) and its recesses (56)(56') in an already assembled container, it braces the central upper area of the container's larger sides (2)(2'), thereby preventing an outward sagging or flexural effect of said area caused by the pressure exerted by the container's contents on the larger sides (2)(2') or by load displacements during transport. This preferred embodiment of the invention further allows to use the transverse brace's outer face over a finished and assembled container as a display or as an area where any type of information relative to the contained product, origin, breeder and/or details relative to trademarks and usage details, expiration date or proper manipulation of the product may be printed and/or marked.

In the case of this preferred embodiment herein explained, and as it may be observed in the perspective view of FIG. 28.2, the antisagging transverse brace (5*b*) is fitted and positioned level to the upper edge of the larger sides (2)(2'), the tensile resistance function being supported not only by the engagement of the lugs (59) of the larger sides (2) (2') into their slots (52) contained in the antisagging transverse brace (5*b*), but additionally by the contact existing between the recesses (56)(56') made on the upper edge (33) of the larger sides (2)(2') and the perimetrical faces adjacent to the larger edges of the antisagging transverse brace (5*b*). It may be equally noted in FIGS. 28.1 and 28.2 that the container is not provided with any other additional geometric formation that may allow the setting up of any other optional or additional element on the herein described container, as could be the transverse laths (70)(70'), this configuration being the most basic in its category with an optional antisagging transverse brace.

FIGS. 29.1 and 29.2 show in perspective the insertion of optional transverse laths (70)(70') in the case where a transverse antisagging brace (5*b*) is provided on an already assembled container that is further provided with the previously explained configuration for anchoring an antisagging transverse brace (5*b*). In these figures it is clearly shown that there is no other geometric modification made on the sides that may differ from the case explained above in FIG. 28.1 and in short even further stiffness and strength is provided to the arrangement.

In FIG. 30.1 it is possible to visualize the results of an embodiment in perspective of several finished containers with their transverse antisagging braces (5*a*), the containers vertically stacked one on top of the other and with a visioning or ventilating recess (60) made on their larger sides (2)(2'), while in FIG. 30.2 a perspective view of several finished containers is shown provided with their transverse antisagging braces (5*b*), the containers further vertically stacked one on top of the other and where the larger sides (2)(2') are not provided with a visioning recess. These two graphically shown embodiments define the use of one of the two configurations when the antisagging transverse brace (5*a*) (5*b*) is used.

In another additional preferred embodiment of the present invention, shown in FIG. 31.1, any type of slit, opening or cutout designs can be custom made on the lid element (4) to suit the clients who will use the container, based on the possibilities of design by laser cutting and ease of implementation thereof, with the purpose in some cases of viewing the contents of the container from above, in others for further improving the container's inner ventilation or to provide personal characteristics of the design requested by the client who uses the herein described container. An example in perspective view is shown in FIG. 31.2 of several stacked containers configured with a lid (4) having hollowed out and cutout designs.

According to yet another preferred embodiment of the present invention, pre-printed paper or cardboard containing marks, colors and designs required by the client user of the container is glued to the outer faces of the original fiberboards made of ecologic, renewable and biodegradable materials prior to the laser cutting process by which the structural elements necessary for the embodiment of the herein described container are obtained, preferably using for this purpose natural, ecologic and biodegradable glues that will provide an additional ecologic quality seal to the container. Subsequently, the elements obtained by means of laser cutting said fiberboards to manufacture the herein described container shall incorporate all over their outer surface the colors, marks and details required by the client user of the container, contribuing with and added value and a better image to the final product obtained.

Another addition to this invention provides the possibility that at the same time as performing the laser cutting process to obtain the different structural materials that make up the herein described container, engravings may be made on the surface of said elements that, with absolute looks of being made with fire over the exterior of the container, can transmit any kind of idea such as trademarks, logotypes, printed details concerning the contained product such as expiration dates, bar codes and a whole diversity of possibilities that entirely depend on the ingenuity and design provided by the clients users of the self-assemblable container for generic use and preferably exclusively manufactured from ecologic, renewable and biodegradable materials that is herein described.

According to another preferred embodiment of the present invention, and as shown in a plan view of smaller sides (3)(3') in FIG. 32.1, and in a perspective view of the assembled container in FIG. 32.2, the possible making of a rectangular orifice (67) with rounded smaller sides is considered in the center of the smaller sides (3) (3') of the container to perform the function of a handhold for transporting the container. The size of said orifice (67) will allow to easily insert the fingers of one hand from the outside in both smaller sides (3)(3') thereby facilitate handling of each individual container.

Due to the great number of possible and varied embodiments of the present invention that refers to a self-assemblable container for generic use, several figures have been made that clearly show in raised side views and side views several stacked containers with the whole set of elements that make up the containers according to some of these preferred embodiments, as well as a perspective view of the corresponding finished container.

For example, in FIGS. 33.1 and 33.2 group of basic containers may be visualized without any other additional element, without recesses to allow visioning or ventilation through their larger sides (2) (2') and without an orifice in the manner of a handhold in its smaller side (3) (3').

In FIGS. 34.1, 34.2 and 34.3 a group of basic containers may be seen without any other additional element, with recesses (60) to allow visioning or ventilation through their larger sides (2) (2') and with orifices in the manner of a handhold in its smaller sides (3)(3').

In FIGS. 35.1, 35.2 and 35.3 a group of basic containers may be noticed with an additional lid (4), without the additional transverse antisagging bracing function, without recesses to allow visioning or ventilation through their larger sides (2)(2') and with orifices in the manner of a handhold in its smaller sides (3)(3').

In FIGS. 36.1, 36.2 and 36.3 a group of basic containers may be visualized with an additional lid (4), with the function of a transverse antisagging brace added to the lid (4) itself, without recesses to allow visioning or ventilation through their larger sides (2)(2'), providing the assembly with an airtight aspect.

In FIGS. 37.1, 37.2 and 37.3 a group of basic containers may be seen with its additional lid (4), to which the additional transverse antisagging bracing function has been added, and some recesses have been made to allow visioning or ventilation through their larger sides (2)(2').

In FIGS. 38.1, 38.2 and 38.3 a group of basic containers may be visulaized, that are configured to allow the addition of transverse laths (70)(70'), where recesses (60) have been made to allow visioning or ventilation through its larger sides (2)(2') and orifices (67) have been made in the manner of handholds on the smaller sides (3)(3') thereof.

In FIGS. 39.1, 39.2 and 39.3 it is possible to view a group of basic containers provided at the same time with two of the optional additional functions described in this invention: first, the two transverse laths (70) (70) and then the transverse antisagging brace (5*b*) in its geometric configuration associated with the application of tensile strength on the larger sides (2) (2') when these are not provided with recesses made to allow visioning and ventilation of the interior, and provided with orifices (67) made in the manner of handholds on their smaller sides (3)(3').

In FIGS. 40.1, 40.2 and 40.3 it is possible to visualize a group of basic containers provided again with two of the optional additional functions described in this invention: the two transverse laths (70) (70) and also the transverse antisagging brace (5*a*) in its geometric configuration associated with the application of tensile strength on the larger sides (2) (2') when these are provided with recesses made to allow visioning and ventilation of the interior, and provided with orifices (67) in the manner of handholds on their smaller sides (3)(3').

As it may be noticed in the figures and from the description of the present invention, any one of the possible combinations allowed under the geometrically depicted descriptions may be applied independently or combined to the basic assembled container and in added fashion to its basic elements consisting of a bottom (1), two larger sides (2)(2') and two smaller sides (3)(3'), so as to provide in this way the possibility of adding at the same time to the same a lid (4), transverse laths (70)(70') and a transverse antisagging brace (5*a*) or (5*b*) in a combination of said additional and optional elements, in order to ensure that the type of container finally configured shall withstand the working conditions, loads and torsions to which it shall be subjected, depending on the type of contents or the selection made by the clients users of the same.

Although the present invention has been described above with reference to several preferred embodiments of the same, showing several modifications and combinations of different characteristics thereof, the invention is not intended to be limited to these embodiments. Other modifications and/or combinations of the same will occur to the experts in the art that shall equally fall within the scope of the present invention. For example, although in the present document all the above described embodiments comprise two longitudinal larger sides and two transverse smaller sides, it is clear that the present invention also includes the possibility of manufacturing containers of other sizes and/or number of sides, for example with two longitudinal sides and two transverse sides of equal size resulting in a square container.

In the same way, although very specific embodiments have been described about the position and shape of the various tabs, lugs and slots for assembling the container according to the present invention, other shapes, numbers and positions of the same shall be equally possible within the scope of the present invention.

It has been duly explained over the preceding description that there will be preferred embodiments of the invention that shall not comprise all the elements described above; for example, it is possible to dispense with the lid, the antisagging brace, the transverse laths, the recesses on the smaller sides in the manner of handholds, the slots and flaps for vertical stacking, etc.

The invention claimed is:

1. Self-assemblable container that comprises the following main structural elements:

a bottom, two longitudinal or larger sides, and two transverse or shorter sides, said main structural elements having a quadrangular shape, and being made of original medium-density or high-density fiberboard, wherein the perimetrical faces of the structural elements of the selfassemblable container are cauterized to provide a supplementary seal against moisture penetration within the structural elements, wherein a first main structural elements comprises, on a side adjacent to a second corresponding main structural element, either tensile resistant flexible tabs or receiving slots, the second corresponding main structural element on said side adjacent to the first main structural element respectively comprising the other of slots or tensile resistant flexible tabs, the main structural elements being assembled together by the introduction of the tensile resistant flexible tabs into the receiving slots wherein the main structural elements comprise an outer edge and the tensile resistant flexible tabs have an outer face or surface, and wherein the tensile resistant flexible tabs are selected from the group consisting of:

a rigid rectangular projection and a flexible area, the flexible area delimited by two cuts, wherein the first of these cuts generates a triangular hollow out wherein a first portion of said first cut initiates at the outer face of the flexible tab and is perpendicular thereto, separating the flexible area from the rigid rectangular projection, wherein the second cut initiates at the outer edge of the main structural element and runs parallel to a second portion of said first cut and separated therefrom at a distance taking a direction which is slanted with respect to the outer edge of the main structural element and toward the interior of the main structural element, and a flexible double tab configured in the shape of a blunted point arrow body with a blunted point arrowhead oriented towards the outside of the main structural element and an arrow base perpendicular to the outer edge of the main structural element, the base of the arrow body prolonged towards the interior of the main structural element by two cuts parallel to each other, and a "V" shaped cut at a central axis of the flexible double tab with the open area of the "V" centered on the outer face of the flexible double tab and the opposite vertex of the "V" oriented inwards of the main structural element, creating a triangular hollow out.

2. Self-assemblable container according to claim 1, wherein the rigid rectangular projection has a chamfer to help in the positioning of the rigid rectangular projection in the receiving slot.

3. Self-assemblable container according to claim 1, wherein the flexible area comprises a chamfer which precedes a triangular fluke which laterally and outwardly stands out for retaining the flexible area in the receiving slot.

4. Self-assemblable container according to claim 1, wherein a first main structural element further comprises, on a side adjacent to a second corresponding main structural element, either blocking lugs or slots, the second corresponding main structural element respectively comprising the other of slots or blocking lugs on said side adjacent to the first main structural element, the blocking lugs being inserted into the corresponding slots to improve the structural stiffness of the self-assemblable container.

5. Self-assemblable container according to claim 1, wherein it further comprises a blocking and bracing system applied against the upper part of longitudinal sides to prevent outward sagging due to the pressure that the contents of the self-assemblable container may apply from within against the sides of the self-assemblable container.

6. Self-assemblable container according to claim 5, wherein the blocking and bracing system consists of an anti-sagging brace that is pressure fitted to the upper edges of the longitudinal sides by means of projecting lugs located on these longitudinal sides that in a manner of male parts are lodged in the receiving slots contained in the smaller edges of the antisagging brace in two variants, the first variant being for use in cases where the self-assemblable container is provided with recesses made on the upper edges of the longitudinal sides for visioning and/or refrigeration of the container interior, and the second variant being for use in cases where the longitudinal sides are not provided with said recesses on their upper edges, thereby imparting the aspect of an airtight container that does not allow viewing the products contained within.

7. Self-assemblable container according to claim 1, wherein it further comprises a lid that is pressure fitted over the finished self-assemblable container, said lid being secured by alignment of standing out lugs made on the upper edges of the longitudinal and transverse sides of the container into receiving slots (made for that purpose in the perimeter of said lid, thereby blocking the lid and, in addition, providing structural strength to the finished assembly, covering the container's top, and serving also as a blocking and bracing system.

8. Self-assemblable container according to claim 1, wherein it further comprises an additional support system consisting of two transverse laths located along the upper perimeter of the transverse sides, providing as well support for the longitudinal sides of the finished self-assemblable container.

9. Self-assemblable container according to claim 1, wherein the shorter and larger sides have an upper edge from which flaps stand out for blocking and vertically stacking one self-assemblable container on top of another.

10. Self-assemblable container according to claim 9, wherein it comprises two flaps on each shorter side and two flaps on each larger side.

11. Self-assemblable container according to claim 9, wherein the shorter and larger sides have a lower edge with recesses arranged to lodge the flaps of another similar container placed below, and the bottom of the container comprises slots corresponding with said recesses arranged to receive the flaps of said similar self-assemblable container placed below, thereby blocking one self-assemblable container on top of the other.

12. Self-assemblable container according to claim 11, wherein it comprises semicircular recesses on each larger side arranged to lodge the flaps when a self-assemblable container is placed on top of another similar container, blocking horizontal displacements thereof.

13. Self-assemblable container according to claim 1, wherein it further comprises a recess on the longitudinal sides that delimits an area on the longitudinal sides of the self-assemblable container for visioning or ventilating the contents of the selfassemblable container.

14. Self-assemblable container according to claim 1, wherein it further comprises an orifice on the transverse sides of the container arranged to perform the function of a handhold for transporting the container.

15. Method of manufacturing the structural elements of a self-assemblable container according to claim 1, wherein the structural elements are selected from the group comprising a bottom, two longitudinal sides, two transverse sides and a lid, wherein said method comprises the step of laser cutting said structural elements from original medium-density or high-density fiberboard, for providing a cauterization to the perimetrical faces of the structural elements and thus imparting a supplementary seal against moisture penetration to said structural elements.

16. Method according to claim 15, wherein it further comprises selecting said structural elements from the group consisting of an anti sagging brace and transverse laths.

17. Method according to claim 15, wherein prior to said laser cutting step it further comprises the step of gluing onto the original boards pre-printed recycled paper that contains required designs.

18. Method according to claim 17, wherein natural, ecologic and biodegradable glues are used in the gluing step.

19. Method according to claim 1, wherein it further comprises the step of making engravings on the surface of the structural elements.

20. Method according to claim 19, wherein the engraving step is simultaneous with the laser cutting step.

21. Self-assemblable container according to claim 1, wherein the flexible double tabs are configured with respective rounded chamfers at the outer corners of the outer face to help in the correct positioning of the flexible double tabs in the receiving slots.

22. Self-assemblable container according to claim 21, wherein the chamfers end in two triangular flukes that stand out laterally from the flexible double tabs for acting as a retaining or non-return element once the flexible double tabs are inserted through the receiving slots.

* * * * *

UNITED STATES PATENT AND TRADEMARK OFFICE

CERTIFICATE OF CORRECTION

PATENT NO. : 8,794,463 B2
APPLICATION NO. : 13/184968
DATED : August 5, 2014
INVENTOR(S) : Juan Jose Rio Gonzalez et al.

It is certified that error appears in the above-identified patent and that said Letters Patent is hereby corrected as shown below:

TITLE PAGE: ITEM (76) SHOULD BE CHANGED TO (75)

TITLE PAGE: ITEM (73)

Please insert the name of the assignee: --COMPANIA DE PATENTES DEL PACIFICO SPA.--

ITEM (30)

Please correct the filing date of the Chilean Priority Application No. 779-2010 from:
June 22, 2010 to JULY 22, 2010.

Signed and Sealed this
Twentieth Day of January, 2015

Michelle K. Lee

Michelle K. Lee
*Deputy Director of the United States Patent and Trademark Office*